US009661737B2

(12) United States Patent
Trbojevic

(10) Patent No.: US 9,661,737 B2
(45) Date of Patent: May 23, 2017

(54) NON-SCALING FIXED FIELD ALTERNATING GRADIENT PERMANENT MAGNET CANCER THERAPY ACCELERATOR

(71) Applicant: Dejan Trbojevic, Wading River, NY (US)

(72) Inventor: Dejan Trbojevic, Wading River, NY (US)

(73) Assignee: The United States of America, as represented by the Department of Energy, Washington, DC (US)

( * ) Notice: Subject to any disclaimer, the term of this patent is extended or adjusted under 35 U.S.C. 154(b) by 257 days.

(21) Appl. No.: 14/285,706

(22) Filed: May 23, 2014

(65) Prior Publication Data

US 2014/0252994 A1 Sep. 11, 2014

Related U.S. Application Data

(63) Continuation-in-part of application No. 13/461,914, filed on May 2, 2012, now abandoned.

(51) Int. Cl.
*H05H 13/08* (2006.01)

(52) U.S. Cl.
CPC ..... *H05H 13/085* (2013.01); *H05H 13/08* (2013.01)

(58) Field of Classification Search
None
See application file for complete search history.

(56) References Cited

U.S. PATENT DOCUMENTS 5,436,537 A * 7/1995 Hiramoto ..... H05H 13/00 315/507
5,631,525 A * 5/1997 Toyota ..... H05H 7/04 313/62
5,680,018 A * 10/1997 Yamada ..... H01S 3/0903 315/500
5,789,875 A * 8/1998 Hiramoto ..... H05H 7/08 313/505
7,432,516 B2 * 10/2008 Peggs ..... H05H 13/04 250/281
7,880,146 B2 * 2/2011 Johnstone ..... H05H 7/06 250/396 R
8,089,054 B2 * 1/2012 Balakin ..... A61N 5/10 250/396 R
8,264,173 B2 * 9/2012 Bertozzi ..... H05H 11/00 315/500

(Continued)

*Primary Examiner* — Douglas W Owens
*Assistant Examiner* — Srinivas Sathiraju
(74) *Attorney, Agent, or Firm* — Timothy L. Harney; Daniel D. Park; Brian J. Lally

(57) ABSTRACT

A non-scaling fixed field alternating gradient accelerator includes a racetrack shape including a first straight section connected to a first arc section, the first arc section connected to a second straight section, the second straight section connected to a second arc section, and the second arc section connected to the first straight section; an matching cells configured to match particle orbits between the first straight section, the first arc section, the second straight section, and the second arc section. The accelerator includes the matching cells and an associated matching procedure enabling the particle orbits at varying energies between an arc section and a straight section in the racetrack shape.

8 Claims, 22 Drawing Sheets

(56) References Cited

U.S. PATENT DOCUMENTS

| | | | | |
|---|---|---|---|---|
| 8,378,311 | B2 * | 2/2013 | Balakin | A61N 5/10 250/396 R |
| 8,436,327 | B2 * | 5/2013 | Balakin | A61N 5/10 250/396 R |
| 8,836,249 | B2 * | 9/2014 | Bertozzi | H05H 13/08 315/500 |
| 2009/0174509 | A1 * | 7/2009 | Bertozzi | H05H 13/04 335/219 |
| 2010/0038552 | A1 * | 2/2010 | Trbojevic | A61N 5/10 250/396 ML |
| 2012/0013274 | A1 * | 1/2012 | Bertozzi | H05H 13/08 315/504 |

* cited by examiner $$\rho_o = \frac{p_c}{eB} \qquad \rightarrow p_c = 1.62141\,\frac{MeV}{c}$$

$$\rho_{\max} = \frac{p_{\max}}{eB} \qquad \rightarrow p_{\max} = 2.43213\,\frac{MeV}{c}$$

$$\rho_{\min} = \frac{p_{\min}}{eB} \qquad \rightarrow p_{\min} = 0.81071\,\frac{MeV}{c}$$

| | POS | S | QX | BX | AX | X | DX | QY | BY | AY | Y | DY | VX-MM | VDX-MR | VY-MM | VDY-MR |
|---|---|---|---|---|---|---|---|---|---|---|---|---|---|---|---|---|
| 72 | QF2N | 1.791 | 0.807 | 0.466 | -0.0001 | 0.0558 | -0.0005 | 0.104 | 2.160 | 0.0142 | 0.0 | 0.0 | 16.39 | -0.4580 | 0.0 | 0.0 |
| 73 | QF2X | 1.852 | 0.829 | 0.394 | 1.1039 | 0.0522 | -0.1151 | 0.108 | 2.570 | -7.0958 | 0.0 | 0.0 | 14.92 | -47.4510 | 0.0 | 0.0 |
| 74 | DL4 | 1.854 | 0.830 | 0.390 | 1.0926 | 0.0520 | 0.1083 | 2.599 | 2.599 | -7.1358 | 0.0 | 0.0 | 14.82 | -47.4510 | 0.0 | 0.0 |
| 75 | EDEN | 1.873 | 0.839 | 0.349 | 0.9834 | 0.0499 | -0.0980 | 0.109 | 2.886 | -7.4784 | 0.0 | 0.0 | 13.98 | -38.9220 | 0.0 | 0.0 |
| 76 | BDEX | 1.892 | 0.848 | 0.313 | 0.8742 | 0.0481 | 0.1104 | 3.186 | 3.186 | -7.8111 | 0.0 | 0.0 | 13.31 | -30.3870 | 0.0 | 0.0 |
| 77 | DL3 | 1.894 | 0.849 | 0.309 | 0.8629 | 0.0479 | -0.0810 | 0.111 | 3.217 | -7.8500 | 0.0 | 0.0 | 13.25 | -30.3870 | 0.0 | 0.0 |
| 78 | QD1N | 1.940 | 0.875 | 0.271 | 0.0000 | 0.0461 | -0.0016 | 0.113 | 3.588 | 0.0119 | 0.0 | 0.0 | 12.55 | -0.4550 | 0.0 | 0.0 |
| 79 | QD1X | 1.986 | 0.901 | 0.309 | -0.8630 | 0.0478 | 0.0778 | 0.115 | 3.215 | 7.8684 | 0.0 | 0.0 | 13.21 | 29.4280 | 0.0 | 0.0 |
| 80 | DL3 | 1.988 | 0.902 | 0.313 | -0.8743 | 0.0480 | 0.0778 | 0.115 | 3.183 | 7.8292 | 0.0 | 0.0 | 13.27 | 29.4280 | 0.0 | 0.0 |
| 81 | EDEN | 2.008 | 0.911 | 0.349 | -0.9835 | 0.0497 | 0.0948 | 0.116 | 2.883 | 7.4945 | 0.0 | 0.0 | 13.92 | 37.9630 | 0.0 | 0.0 |
| 82 | BDEX | 2.027 | 0.919 | 0.390 | -1.0927 | 0.0517 | 0.1119 | 0.117 | 2.595 | 7.1499 | 0.0 | 0.0 | 14.74 | 46.4930 | 0.0 | 0.0 |
| 83 | DL4 | 2.029 | 0.920 | 0.394 | -1.1040 | 0.0519 | 0.1119 | 0.117 | 2.567 | 7.1097 | 0.0 | 0.0 | 14.83 | 46.4930 | 0.0 | 0.0 |
| 84 | QF1N | 2.090 | 0.942 | 0.463 | 0.0536 | 0.0552 | -0.0066 | 0.121 | 2.172 | -0.2691 | 0.0 | 0.0 | 16.20 | -2.0630 | 0.0 | 0.0 |
| 85 | QF1X | 2.150 | 0.964 | 0.383 | 1.1733 | 0.0511 | -0.1242 | 0.126 | 2.641 | -7.8616 | 0.0 | 0.0 | 14.59 | -50.2410 | 0.0 | 0.0 |
| 86 | DL4 | 2.152 | 0.965 | 0.378 | 1.1609 | 0.0509 | -0.1242 | 0.126 | 2.673 | -7.9092 | 0.0 | 0.0 | 14.49 | -50.2410 | 0.0 | 0.0 |
| 87 | EDEN | 2.172 | 0.974 | 0.335 | 1.0404 | 0.0486 | -0.1072 | 0.127 | 2.992 | -8.3235 | 0.0 | 0.0 | 13.60 | -41.7140 | 0.0 | 0.0 |
| 88 | BDEX | 2.191 | 0.984 | 0.296 | 0.9199 | 0.0467 | -0.0901 | 0.128 | 3.326 | -8.7266 | 0.0 | 0.0 | 12.88 | -33.1810 | 0.0 | 0.0 |
| 89 | DL3 | 2.193 | 0.985 | 0.293 | 0.9074 | 0.0465 | -0.0901 | 0.128 | 3.361 | -8.7731 | 0.0 | 0.0 | 12.81 | -33.1810 | 0.0 | 0.0 |
| 90 | QD8N | 2.239 | 1.012 | 0.250 | 0.0563 | 0.0442 | -0.0121 | 0.130 | 3.796 | -0.4161 | 0.0 | 0.0 | 11.96 | -3.9490 | 0.0 | 0.0 |
| 91 | QD8X | 2.285 | 1.041 | 0.282 | -0.7693 | 0.0454 | 0.0651 | 0.132 | 3.430 | 8.1140 | 0.0 | 0.0 | 12.44 | 24.8460 | 0.0 | 0.0 |
| 92 | DL3 | 2.287 | 1.042 | 0.285 | -0.7806 | 0.0455 | 0.0651 | 0.132 | 3.398 | 8.0751 | 0.0 | 0.0 | 12.49 | 24.8460 | 0.0 | 0.0 |
| 93 | EDEN | 2.172 | 1.052 | 0.317 | -0.8898 | 0.0469 | 0.0821 | 0.133 | 3.089 | 7.7457 | 0.0 | 0.0 | 13.05 | 33.3840 | 0.0 | 0.0 |
| 94 | BDEX | 2.641 | 1.061 | 0.354 | -0.9991 | 0.0487 | 0.0992 | 0.134 | 2.792 | 7.4062 | 0.0 | 0.0 | 13.78 | 41.9170 | 0.0 | 0.0 |
| 95 | DL4 | 2.673 | 1.062 | 0.358 | -1.0104 | 0.0489 | 0.0992 | 0.134 | 2.762 | 7.3662 | 0.0 | 0.0 | 13.86 | 41.9170 | 0.0 | 0.0 |
| 96 | QFEN | 2.992 | 1.086 | 0.426 | -0.0324 | 0.0518 | -0.0079 | 0.138 | 2.353 | -0.2884 | 0.0 | 0.0 | 15.10 | -1.5670 | 0.0 | 0.0 |
| 97 | QFX1 | 3.326 | 1.105 | 0.427 | 0.0085 | 0.0510 | -0.0214 | 0.141 | 2.427 | -1.2020 | 0.0 | 0.0 | 14.89 | -7.1210 | 0.0 | 0.0 |
| 98 | OC1 | 3.361 | 1.288 | 2.468 | -2.1851 | 0.0310 | -0.0214 | 0.182 | 5.566 | -2.1462 | 0.0 | 0.0 | 8.21 | -7.1210 | 0.0 | 0.0 |
| 99 | QDX2 | 3.796 | 1.292 | 3.423 | -12.4721 | 0.0320 | 0.0510 | 0.184 | 4.678 | 13.8943 | 0.0 | 0.0 | 8.62 | 19.1250 | 0.0 | 0.0 |
| 100 | OC2 | 3.430 | 1.292 | 3.734 | -13.0291 | 0.0326 | 0.0510 | 0.185 | 4.346 | 13.3891 | 0.0 | 0.0 | 8.86 | 19.1250 | 0.0 | 0.0 |
| 101 | QFX3 | 3.528 | 1.295 | 4.708 | 0.2073 | 0.0334 | -0.0285 | 0.188 | 3.461 | 0.1906 | 0.0 | 0.0 | 9.15 | -10.9180 | 0.0 | 0.0 |
| 102 | OC3 | 3.533 | 1.295 | 4.705 | 0.2062 | 0.0333 | -0.0285 | 0.188 | 3.459 | 0.1891 | 0.0 | 0.0 | 9.09 | -10.9180 | 0.0 | 0.0 |
| 103 | DBX1 | 3.624 | 1.298 | 4.673 | 0.1859 | 0.0296 | -0.0520 | 0.192 | 3.422 | 0.1820 | 0.0 | 0.0 | 7.56 | -22.6230 | 0.0 | 0.0 |
| 104 | OC4 | 3.871 | 1.307 | 4.595 | 0.1314 | 0.0168 | -0.0520 | 0.204 | 3.351 | 0.1077 | 0.0 | 0.0 | 1.99 | -22.6230 | 0.0 | 0.0 |
| 105 | DBX2 | 3.963 | 1.310 | 4.568 | 0.1110 | 0.0141 | -0.0067 | 0.208 | 3.330 | 0.1540 | 0.0 | 0.0 | 0.95 | 0.0000 | 0.0 | 0.0 |
| 106 | OE | 3.963 | 1.310 | 4.568 | 0.1110 | 0.0141 | -0.0067 | 0.208 | 3.330 | 0.1540 | 0.0 | 0.0 | 0.95 | 0.0000 | 0.0 | 0.0 |
| 107 | OPI | 4.464 | 1.327 | 4.513 | 0.0000 | 0.0107 | -0.0067 | 0.233 | 3.253 | 0.0000 | 0.0 | 0.0 | 0.95 | 0.0000 | 0.0 | 0.0 |
| 108 | OSTH | 4.464 | 1.327 | 4.513 | 0.0000 | 0.0107 | -0.0067 | 0.233 | 3.253 | 0.0000 | 0.0 | 0.0 | 0.95 | 0.0000 | 0.0 | 0.0 |

FIG. 14

NON-SCALING FIXED FIELD ALTERNATING GRADIENT PERMANENT MAGNET CANCER THERAPY ACCELERATOR

CROSS-REFERENCE TO RELATED APPLICATIONS

The parent non-provisional application claimed priority to U.S. provisional patent application Ser. No. 61/539,109, filed Sep. 26, 2011, and entitled "NON-SCALING FIXED FIELD ALTERNATING GRADIENT PERMANENT MAGNET CANCER THERAPY ACCELERATOR," the contents of which are incorporated herein by reference. The present continuation-in-part claims priority to Ser. No. 13/461,914 which is incorporated herein by reference. Also incorporated herein by reference is the inventor's patent U.S. Pat. No. 7,582,886 B2 and Pub. No. 2010/0038552A1 for gantry delivery systems for the accelerator.

STATEMENT REGARDING FEDERALLY SPONSORED RESEARCH OR DEVELOPMENT

The present invention was made with government support under Contract Number DE-AC02-98CH10886 awarded to Brookhaven National Laboratory by the Department of Energy (DOE). The U.S. government has certain rights in the invention.

FIELD OF THE INVENTION

Generally, the field of art of the present disclosure pertains to particle accelerator systems and methods, and more particularly, to non-scaling fixed field alternating gradient (FFAG) permanent magnet accelerator systems and methods and associated applications such as cancer therapy and the like.

BACKGROUND OF THE INVENTION

Generally, particle accelerators use electromagnetic fields to propel charged particles at high speeds in well-defined beams. Exemplary applications of particle accelerators include physics experiments, medical applications, energy production, and the like. Exemplary particle accelerators include cyclotrons, synchrotrons, and fixed field alternating gradient accelerators. An exemplary medical application includes proton therapy using a beam of protons to irradiate diseased tissue, such as in the treatment of cancer. Conventionally, most proton and carbon cancer therapy facilities use cyclotrons, with a few exceptions where synchrotrons are used. This is mostly due to cyclotrons' competitive price and ease of operation. Cyclotrons have several disadvantages for proton therapy and the like. First, protons are accelerated in cyclotrons in a continuous mode at maximum energy. To obtain a required energy for a patient, a treatment degrader material is used, and protons lose energy passing through this material. Disadvantageously, this induces radioactivity and has negative impact on beam emittance. Also, cyclotrons always have continuous losses especially at an extraction point. This makes cyclotrons difficult to operate and/or repair, as they need to "cool down" with respect to residual radioactivity (e.g., the cool down period can be up to 10 days). The residual radioactivity also requires building special shielding walls to allow safe operation thereby making installation difficult in medical treatment facilities, for example. Synchrotrons solve the aforementioned problems, but are larger in size, and do not operate continuously. If synchrotrons are fast cycling (i.e., maximum possible today ~60 Hz), they can be competitive to cyclotrons.

Fixed field alternating gradient (FFAG) accelerators are circular particle accelerators that combine the cyclotron advantage of continuous, unpulsed operation, with the synchrotron advantage of relatively inexpensive small magnet ring, of narrow bore. There are two types of FFAG accelerators: scaling and non-scaling (NS). Relative to conventional particular accelerators, there is a need in the art for non-scaling FFAG accelerator systems and methods to address fast acceleration to reduce treatment time, cost considerations both in operation and capital, operational simplicity, and reduction in size.

BRIEF SUMMARY OF THE INVENTION

In an exemplary embodiment, a non-scaling fixed field alternating gradient accelerator includes a racetrack shape including a first straight section connected to a first arc section, the first arc section connected to a second straight section, the second straight section connected to a second arc section, and the second arc section connected to the first straight section; and matching cells configured to match particle orbits between the first straight section, the first arc section, the second straight section, and the second arc section. The first arc section and the second arc section each can include permanent magnets, and the permanent magnets can be a Halbach type. The accelerator can further include an injection septum, a cavity, and an injection kicker in the first straight section configured to receive high energy particles; and at least one extraction kicker and an extraction septum in the second straight section configured to eject the high energy particles. The matching cells can include a first matching cell between the first arc section, the first straight section, and the second arc section; and a second matching cell between the first arc section, the second straight section, and the second arc section; wherein each of the first matching cell and the second matching cell can include six magnets including four quadrupoles and two dipoles.

Each of the first matching cell and the second matching cell can include adjustable variables for matching conditions associated with a single particle energy value. The four quadrupoles can include two defocusing quadrupoles and two focusing quadrupoles and the two dipoles each include opposing bending magnets. The first straight section and the second straight section each can include two halves which are symmetric to one another. Due to symmetry in the first straight section and the second straight section, the matching cells only require a solution for matching particle orbits from one end of one of the first arc section and the second arc section to a middle of one of the first straight section and the second straight section. The matching cells can be configured to take values of the orbits and betatron amplitude functions and propagate them through the first straight section for each momentum coming to same conditions at the first arc section and through the second straight section for each momentum coming to same conditions at the second arc section.

In another exemplary embodiment, a non-scaling fixed field alternating gradient accelerator includes a first matching cell connecting a first arc section to a second arc section with an intermediate first straight section, wherein the first matching cell is configured to match particle orbits between the first straight section and the first arc section and between the first straight section and the second arc section; and a second matching cell connecting the first arc section to the second arc section with an intermediate second straight section, wherein the second matching cell is configured to match particle orbits between the second straight section and the first arc section and between the second straight section and the second arc section. The first arc section and the second arc section each can include permanent magnets, and the permanent magnets can be a Halbach type. The accelerator can further include an injection septum, a cavity, and an injection kicker in the first straight section configured to receive high energy particles; and at least one extraction kicker and an extraction septum in the second straight sections configured to eject the high energy particles. Each of the first matching cell and the second matching cell can include six magnets including four quadrupoles and two dipoles.

Each of the first matching cell and the second matching cell can include adjustable variables for matching conditions associated with a single particle energy value. The four quadrupoles can include two defocusing quadrupoles and two focusing quadrupoles and the two dipoles each include opposing bending magnets. The first straight section and the second straight section each can include two halves which are symmetric to one another; and, due to symmetry in the first straight section and the second straight section, the matching cells only require a solution for matching particle orbits from one end of one of the first arc section and the second arc section to a middle of one of the first straight section and the second straight section. The first matching cell can be configured to take values of the orbits and betatron amplitude functions and propagate them through the first straight section for each momentum coming to same conditions at the first arc section; and the second matching cell can be configured to take values of the orbits and betatron amplitude functions and propagate them through the second straight section for each momentum coming to same conditions at the second arc section.

In yet another exemplary embodiment, a method of designing a non-scaling fixed field alternating gradient accelerator as a racetrack includes determining stable particle orbits for a ring structure including repeating cells; breaking the ring structure into two separate arc structures; providing two straight sections between the two separate arc structures; and providing magnets in each of the two straight sections, wherein the magnets are configured to take values of the orbits and betatron amplitude functions and propagate them through a straight section for each momentum coming to same conditions at an arc structure.

BRIEF DESCRIPTION OF THE DRAWINGS

Exemplary and non-limiting embodiments of the present disclosure are illustrated and described herein with reference to various drawings, in which like reference numbers denote like method steps and/or system components, respectively, and in which:

FIG. 14 is a table of a calculation of the matching procedure of FIGS. 9-12 for the variables;

DETAILED DESCRIPTION OF THE INVENTION

In various exemplary embodiments, the present disclosure relates to NS-FFAG accelerator systems and methods utilizing a "racetrack" design with permanent magnets. The accelerator includes two straight sections connected by two arcs on opposite sides. In an exemplary embodiment, the accelerator systems and methods offer a competitive design for a cancer therapy accelerator relative to conventional cyclotrons or slow extraction synchrotrons used today for cancer therapy accelerators. The accelerator systems and methods can include a racetrack NS-FFAG with fast acceleration assumed with a total number of turns less than 1000. Additionally, the accelerator systems and methods can use permanent separated function magnets of the Halbach structure. In an exemplary embodiment, the orbit offsets presented are within a range 11 mm<Δx<17 mm. This allows use of an aperture of about 30 mm. With an outside diameter of 7.375 cm from the available Nd—Fe—B (for temperatures less than 70 deg. C.) materials a bending dipole field of 2.4 T could be obtained. Advantageously, the accelerator systems and methods include very small magnets and simplified operation, as the magnets are permanent. Acceleration is assumed to be with a fast phase jump scheme where the voltage on the cavities is changed within one turn of the circulating bunch.

The straight sections serves to inject and extract protons. The straight sections accelerates protons via the radiofrequency cavities. As the energy of the protons change throughout the NS-FFAG accelerator, orbits of the proton beam in the arcs oscillate at different radii. Although the differences in the radii are very small in range (−11 mm to −17 mm) they need to be merged going through the straight sections into one orbit. Until the present invention, the beam had not been merged with a NS-FFAG accelerator. It took the inventor over 75 trials to achieve this alignment.

Figure 1:
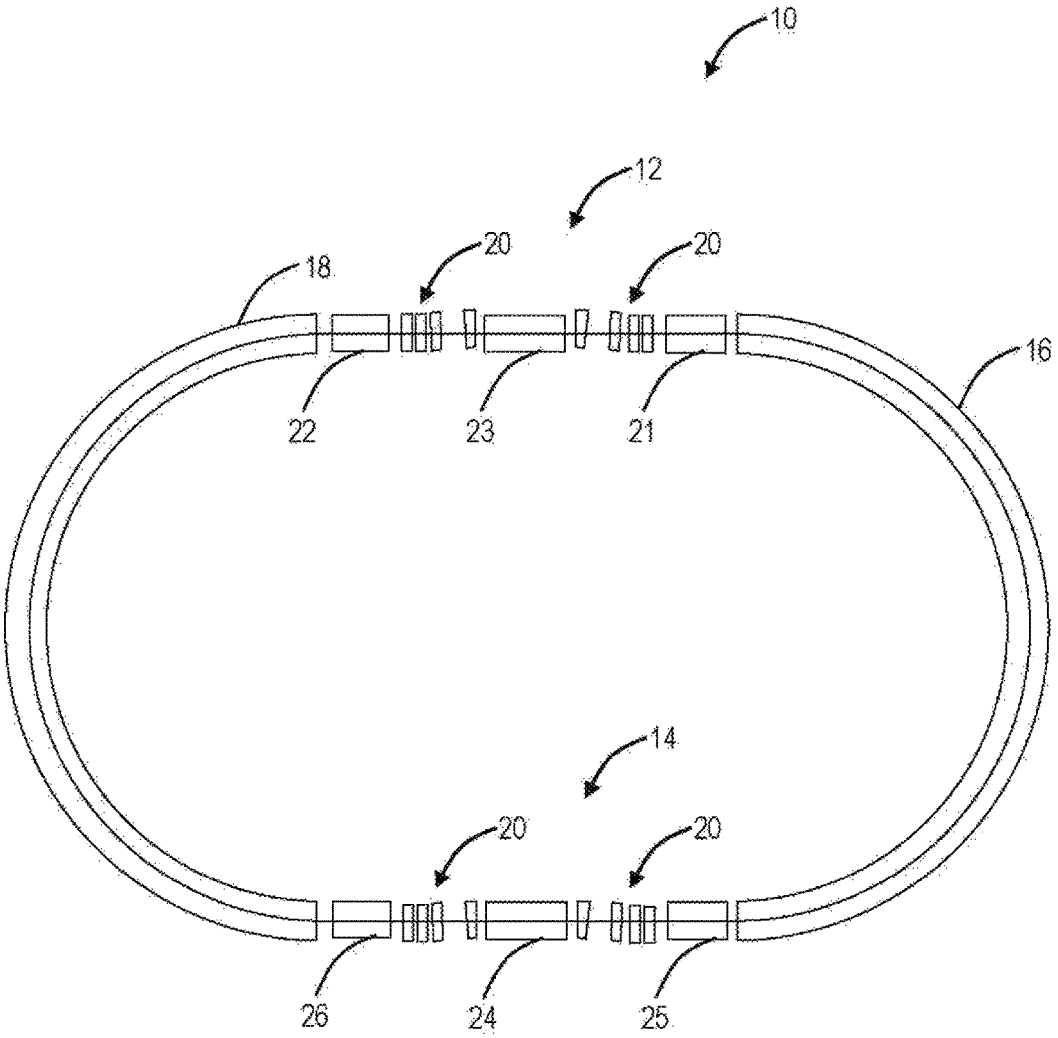
FIG. 1 is a schematic diagram of a NS-FFAG accelerator in a racetrack lattice design.

Referring to FIG. 1, in an exemplary embodiment, a schematic diagram illustrates a NS-FFAG accelerator 10 in a racetrack lattice design. Specifically, the accelerator 10 includes two straight sections 12, 14 connected by two arc sections 16, 18 on opposite sides. The accelerator 10 includes matching cells 20 between the straight sections 12, 14 and the two arc sections 16, 18. The accelerator 10 can utilize permanent magnets thereby reducing size and cost of the accelerator 10 as well as operational costs as there is no required power consumption for the magnets. The two arc sections 16, 18 can include permanent magnets of the Halbach type that are very small. In an exemplary embodiment, the arc sections 16, 18 can have a radius of approximately 2.85 meters and the entire accelerator 10 could be placed in a room of about 7×9 meters. Thus, the accelerator 10 could be located in a medical treatment facility. In operation, a proton beam can be injected at energy of around 30 MeV by injection kickers 21 and septum 22 placed in the straight section 12 of the racetrack. The 30 MeV energy protons are produced by a pre-injector which includes a proton ion source, radiofrequency quadrupole (RFQ), and linac (note, the pre-injector is not shown in FIG. 1). The protons are accelerated by Radio Frequency (RF) cavities 23 placed at the straight section 12. As protons get the energy kick by the cavities 23, their orbit in the arc sections 16, 18 goes around with a different radius. The maximum of the orbit offsets is about $x_{max}$=16.8 mm for the maximum energy protons of about 250 MeV. The minimum energy protons at about 30 MeV have an orbit offset in opposite direction of about $x_{min}$=−10.3 mm. Details of acceleration has been described in detail in D. Trbojevic et al. "Crossing Resonances in a Non-Scaling FFAG," International Journal of Modern Physics A, Volume 26, Issue 10-11, pp. 1852-1864 (2011), the contents of which are incorporated herein by reference. When protons reach a required energy, they are ejected by fast extraction kickers 24, 25 in one turn to an extraction septum 26 located in the straight section 14 and directed by beam lines to a patient delivery system, for example. The patient delivery system is described in the inventor's patent U.S. Pat. No. 7,582,886 B2 and Pub. No. 2010/0038552A1 and incorporated herein by reference.

In an exemplary application, the accelerator 10 can be used as a proton therapy accelerator from 31 MeV to 250 MeV. The dipole bending field is 2.3 T, while the Neodymium Iron Boron magnetic residual induction is Br=1.3 T. The radial orbit offsets in the arc sections 16, 18, for the kinetic energy range between 31 MeV<$E_k$<250 MeV or momentum offset range −50%<δp/p<50%, are −11.6 mm<$x_{max}$<16.8 mm, correspondingly. The straight sections 12, 14 are used for the cavities 23 and single turn injection/extraction kickers 21, 24, 25 and septa 22, 26 are with zero orbit offsets. Advantageously, use of permanent magnets reduces overall capital and operating cost. The accelerator 10 can be used, for example, in proton/carbon ion cancer therapy facilities although other applications are also contemplated. From a design perspective, the accelerator 10 seeks to address two disadvantages of conventional systems and methods, namely cost and size. With respect to cyclotrons, the accelerator 10 includes advantages of providing variable energy without degraders (which introduce radiation and beam emittance blow-up), and the single turn extraction avoids beam loss and residual radiation. With respect to synchrotrons, the accelerator 10 includes advantages of fast acceleration rate making therapy treatments shorter allowing fast spot scanning techniques.

Figure 2:
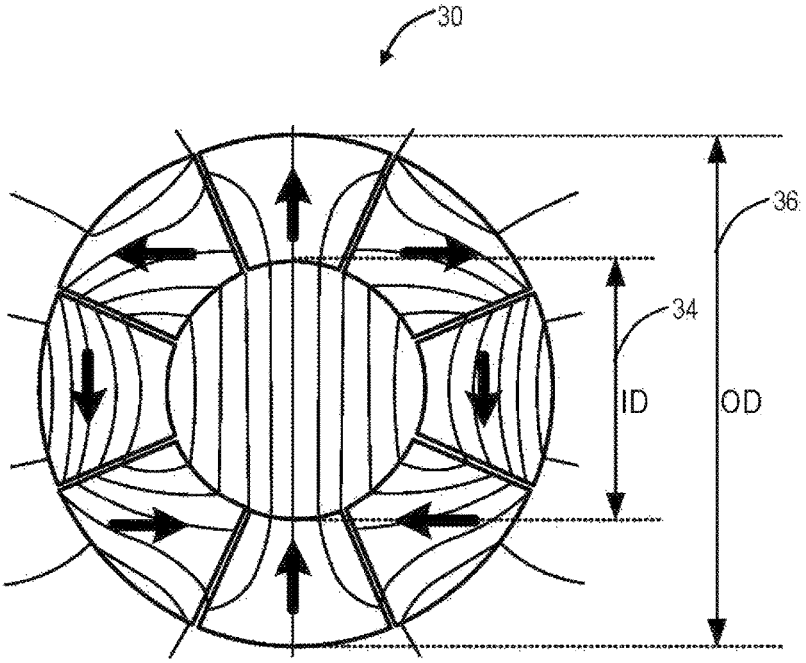
FIG. 2 is a cross sectional view of a Halbach magnet of eight pieces showing the diameter definitions.
Figure 3:
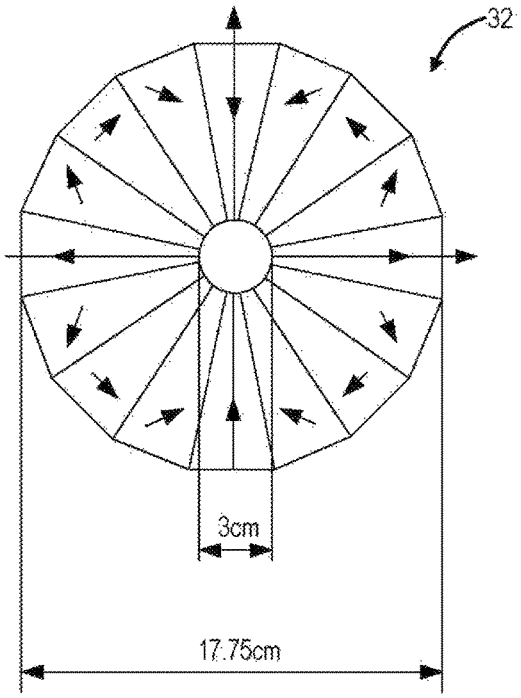
FIG. 3 is a cross sectional view of a Halbach magnet with sixteen slices.
Figure 4:
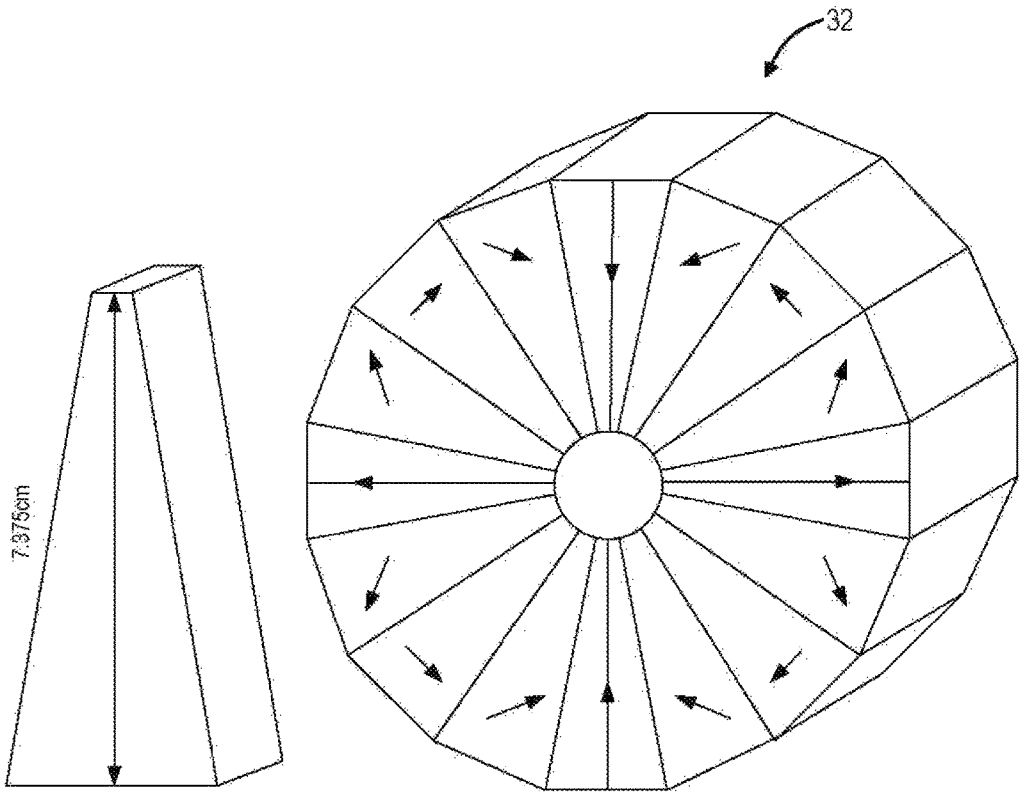
FIG. 4 is a perspective view of the Halbach magnet of FIG. 3.

Referring to FIGS. 2-4, in exemplary embodiments, various diagrams illustrate Halbach magnets 30, 32 for the accelerator 10. The lattice design for the accelerator 10 is based on the properties of the permanent magnets and maximum achievable magnetic fields created by a Halbach structure. FIG. 2 illustrates a cross sectional view of a Halbach magnet 30 of eight pieces showing the diameter definitions. Specifically, the Halbach magnet 30 includes an inner diameter (ID) 34 and an outer diameter (OD) 36. Accordingly, the maximum magnetic field, $B_g$, of the Halbach magnet is $$B_g = B_r \cdot \ln\left(\frac{OD}{ID}\right)$$

where $B_r$ is the material permanent magnetic field value, while OD and ID are outside and inside diameters of the material modules. FIGS. 3 and 4 illustrate a Halbach magnet 32 with sixteen slices producing a better quality magnetic field relative to the Halbach magnet 30. In an exemplary embodiment, the Halbach magnet 32 can be used in the accelerator 10. In an exemplary embodiment, the permanent magnet material used in the accelerator 10 is Neodymium-Iron-Boron (Nd—Fe—B) sintered. A range of $B_r$ nominal values offered by sintered Nd—Fe—B varies between 1.06-1.5 T corresponding to listed names of materials as N2880-N5563, respectively. In an exemplary embodiment, a material "N4561" can be used with a nominal value of $B_r$=1.35 T with a maximum operating temperature of 70 deg. C. In the magnet 32, for the inside radius of $r_{ID}$=3 cm and outside radius $r_{OD}$=7.375 cm, with $B_r$=1.35 T, the dipole bending magnetic field is estimated to be $B_g$=2.4 T. FIGS. 2-4 illustrate slices of the permanent magnets with different magnet orientations (i.e., directions of the magnetization are shown by the arrows) produce a homogenous magnetic field in the center of the magnet 30, 32. In FIGS. 3 and 4, the sixteen slices put together with magnetization directions presented by arrows produce an even more homogeneous field (relative to the eight slices of FIG. 2). Dimensions of the slices with the inside and outside diameters of 3 cm and 17.75 cm, respectively, were chosen to produce the dipole bending field of $B_y$=2.2342 T and quadrupole gradients of $G_f$=118 T/m and G=−125 T/m using the available Neodymium Boron Iron compound with H=1.3 T.

Figure 5:
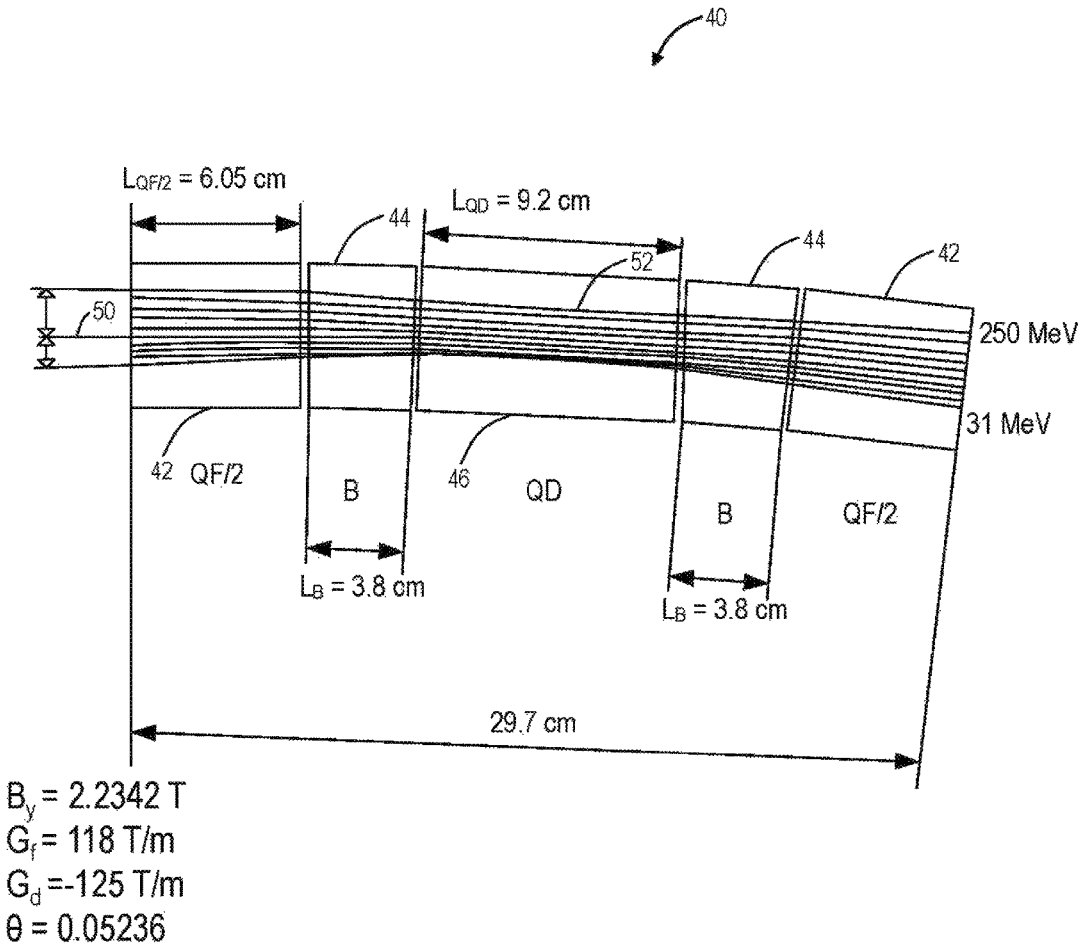
FIG. 5 is a schematic diagram of a repetitive cell for creating arc sections of the accelerator of FIG. 1.

Referring to FIG. 5, in an exemplary embodiment, a schematic diagram illustrates a cell 40 for the arc sections 16, 18 of the accelerator 10. In an exemplary embodiment, the cell 40 can include magnet slices as shown in FIGS. 2-4. That is, focusing quadrupoles, dipoles, defocusing quadrupole magnets are put together to create the repeatable structure in a basic cell with a length of about 29.7 cm. A total of sixty cells 40 would make a ring, and each of the arc sections 16, 18 can include thirty of the cells 40. The cell 40 includes quadrupole focusing (QF) elements 42, magnets (B) 44, and a quadrupole defocusing (QD) element 46. In an exemplary embodiment, the elements 42 are split in half (labeled QF/2) with the magnets 44 and the QD element 46 disposed there between. The QF elements 42 is a single 12.1 cm focusing magnet divided artificially into two parts. The magnets 44 are dipoles separated by the QD element 46. Due to difficulties in obtaining strong magnetic fields using permanent magnets, the magnets 44 include separated function magnets.

In an exemplary embodiment, the length of the elements 42, $L_{QF/2}$, is 6.05 cm, the length of the magnets 44, $L_B$, is 3.8 cm, the length of the element 46, $L_{QD}$, is 9.2 cm, and the end-to-end length of the cell 40 is 29.7 cm. There is an optimal choice for the magnet 42, 44, 46 lengths with respect to the smallest orbit offsets which also define the size of the accelerator 10. At the same time the length of the dipole magnets 44 is chosen to allow the required angle=2*PI/Ndipoles. A total number of dipoles is 120, two per each cell for the total of 60 cells for the whole circle or 30 cells per each arc in the racetrack configuration. The cell 40 includes a center reference line 50 through the elements 42, 44, 46. From this reference line 50, proton kinetic energy 52 is shown in a range of 30-250 MeV. Specifically, at a distance approximately 16.8 mm from the reference line 50, the proton kinetic energy 52 is approximately 250 MeV and at a distance of approximately −10.5 mm from the reference line 50 in an opposite direction, the proton kinetic energy 52 is approximately 30 MeV.

Figure 6:
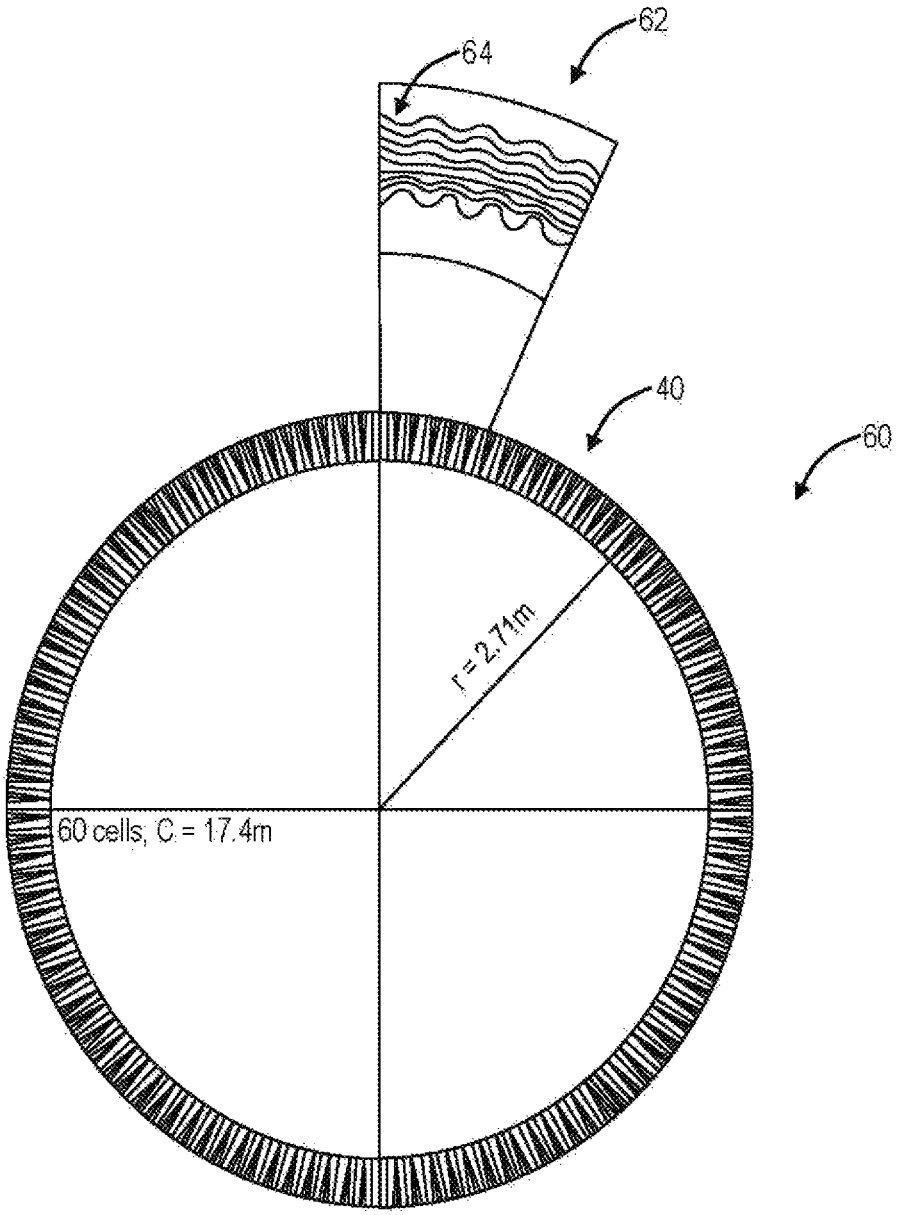
FIG. 6 is a schematic diagram of a ring made of sixty of the repetitive cells from FIG. 5 as well as showing particle orbits therethrough.

Referring to FIG. 6, in an exemplary embodiment, a schematic diagram illustrates a ring 60 made of sixty of the cells 40. The ring 60 also illustrates orbits magnified by 20 times. The ring 60 has a radius of approximately 2.71 m and a circumference of approximately 17.4 m. Conceptually, the accelerator 10 includes the ring 60 broken by the two straight sections 12, 14. That is, the ring 60 represents a combination of the two arc sections 16, 18 without the intervening straight sections 12, 14. Note, the straight sections 12, 14 are needed for acceleration via the RF cavities 23 and insertion/extraction via the kickers 21, 24, 25. Of note, the addition of the straight sections 12, 14 to the ring 60/arc sections 16, 18 presents a difficult problem for matching the orbits there between. Specifically, the matching cell 20 is required between the straight sections 12, 14 and the arc sections 16, 18. FIG. 6 also includes an expanded view 62 of a portion of the ring 60 illustrating particle orbits 64 through the ring 60. The orbits 64 include maximum, intermediate, and minimum energy orbits.

Figure 7:
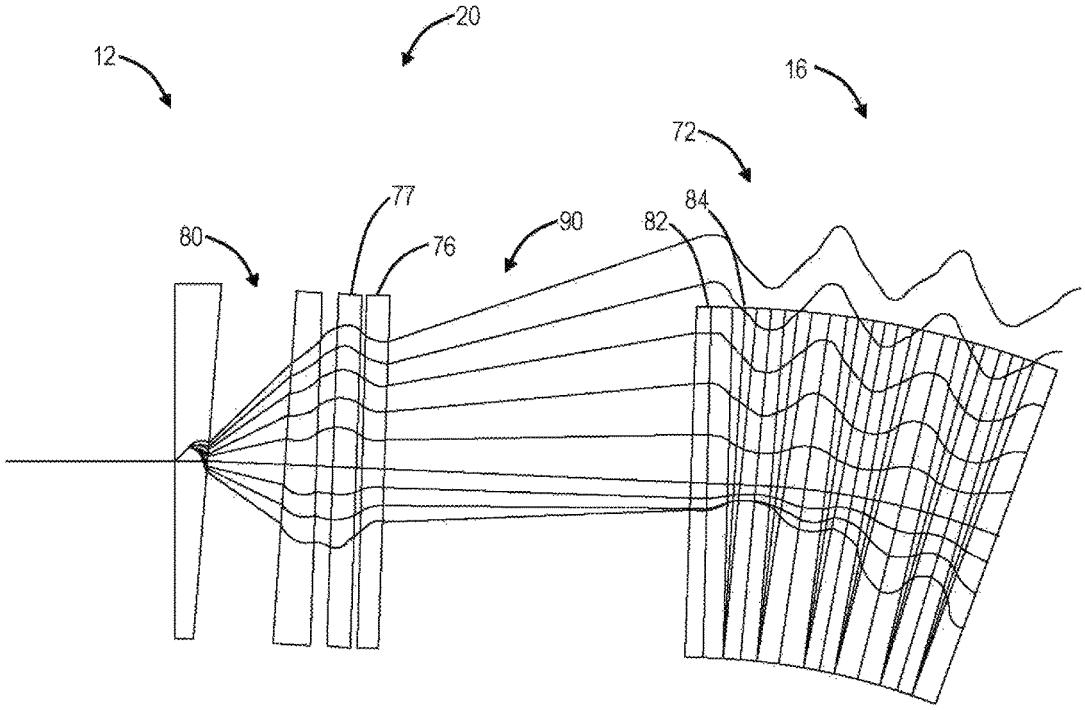
FIG. 7 is a schematic diagram of a portion of a matching cell for the accelerator of FIG. 1.
Figure 8:
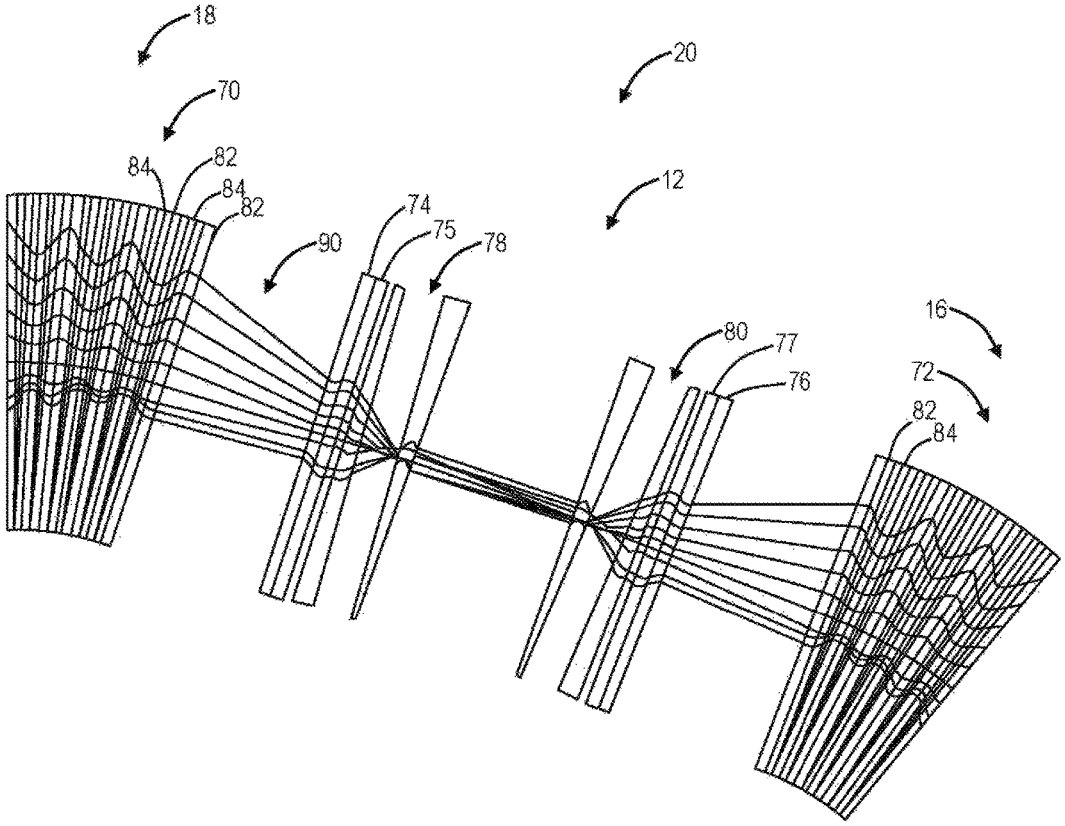
FIG. 8 is a schematic diagram of a full matching cell for the accelerator of FIG. 1.

Referring to FIGS. 7 and 8, in exemplary embodiments, schematic diagrams illustrate the matching cell 20 showing several particle orbits there through. FIG. 7 shows a portion of the matching cell 20, showing an interface between the straight section 12, 14 and the corresponding arc section 16, 18. FIG. 8 shows the entire matching cell 20 between the arc sections 16, 18. The matching cell 20 interfaces to magnets 70, 72 in each of the arc sections 16, 18 respectively. In the straight sections 12, 14, the matching cell 20 includes quadrupoles 74, 75, 76, 77 and two opposing bending magnets 78, 80. The magnets 70, 72 include various quadrupoles 82 followed by dipoles 84 in a repeating fashion such as described in FIG. 6. FIGS. 7 and 8 also include orbits 90 for different energies that are magnified 100 times, with a maximum of 16.8 mm. In operation, the matching cell 20 is configured to reduce orbit offsets to zero in the straight sections 12, 14 for all energies, e.g. 30 MeV-250 MeV.

The matching cell 20 has to accommodate numerous constraints. First, at a specific energy, four amplitude functions and their slopes [$\beta_x$, $\beta_y$, $\alpha_x$, $\alpha_y$] from the arc sections 16, 18 have to match the ones from the straight sections 12, 14 as well and the dispersion function with its slope $D_x$ and $D_x'$. Next, radial orbit offsets in the arc sections 16, 18 at the specific energy need to be annulled so the particles continue with zero slopes at the end of the matching cell 20. Third, in addition to these constraints above, the same conditions are required for any energy during acceleration from the minimum to the maximum energies (e.g., 30 MeV-250 MeV). For the matching cell 20, available variables include four gradients in the quadrupoles, two bending angles of the dipoles, and distances between the magnets 70, 72, 74, 76, 78, 80. A major difficulty in this matching procedure in the matching cell 20 is that it is possible to match conditions at only single particle energy.

The design of the accelerator 10 requires finding solutions for the largest and smallest energy. This was performed by a trial and error procedure, i.e., solutions for the highest energy (250 MeV) were applied for the smallest energy (30 MeV) and opposite until both conditions were fulfilled. Over 75 trials were required. In this process, an additional constraint for the orbit offsets and their slopes was used in a multiple fitting procedure. After the solution was obtained by the SYNCH code, an additional Polymorphic Tracking Code (author is Etienne Forest, KEK Japan) was used to confirm the obtained solutions and do the final check.

The design of the accelerator 10 includes a matching procedure 100 to match particle orbits between the sections 12, 14, 16, 18. The matching procedure 100 uses an accelerator physics program called SYNCH (authored by A. Garren and Ernest Courant) (available online at www.cap.bnl.gov/SYNCH). In particular, the SYNCH program can be used to solve the problem of matching orbits and Courant-Snyder invariants for different energies—momenta—(amplitude functions $\beta_x$, $\beta_y$ and their slopes $\alpha_x$ and $\alpha_y$ for the horizontal and vertical transverse motion of the particles in the accelerator).

The matching procedure 100, using the SYNCH program, produces required values for the Courant-Snyder amplitude functions starting with defined initial conditions using enough variables. In the context of the accelerator 10, two structures are required one for the straight sections 12, 14 and one for the arc sections 16, 18. The periodic structure of the arcs cells has created stable orbits for protons between kinetic energies of 31-250 MeV. That is, protons with kinetic energies of 31-250 MeV have stable orbits in the arc sections 16, 18 as shown by the particle orbits 64 in FIG. 6. The orbits for each energy-momentum are parallel inside of the available aperture. The goal of the matching procedure 100 is to cut the existing ring 60 in half thereby forming the two arc sections 16, 18, take the values of the orbits, betatron amplitude functions, and propagate them through the straight sections 12, 14 for each momentum, and come to the same conditions to the second arc.

Initial conditions for the matching procedure 100 are very well defined from the closed orbits of the non-scaling Fixed Field Alternating Gradient ring 60 presented in FIG. 6. The matching procedure 100 can utilize a simplification due to symmetry, namely each of the straight sections 12, 14 could be divided in half with mirror symmetry of each halves. FIG. 7 illustrates a first half of the straight sections 12, 14. Due to this symmetry, the quadrupole 74 can be the same as the quadrupole 76, the quadrupole 75 can be the same as the quadrupole 77, and the opposing bending magnets 78 can be the same as the opposing bending magnets 80. The first part of the straight section 12, 14 will start with the end of the arc section 16, 18 with the element 42 from FIG. 5, i.e. half of a focusing quadrupole. The quadrupole 76 is a defocusing quadrupole denoted as QDX2 followed by the quadrupole 77 which is a focusing quadrupole denoted as QFX3. A major role of these quadrupoles 76, 77 is to the match the betatron functions from the arc section 16, 18 to the center of the straight section 12, 14. The quadrupoles 76, 77 are followed by the two opposite bending dipoles 80. Note, the quadrupoles 74, 75 and the dipoles 78 can be the same as the quadrupoles 76, 77 and the dipoles 80 due to symmetry.

Due to the symmetry conditions it is enough to create a solution from the end of one arc section 16, 18 to the middle of the straight section 12, 14 by requiring that the slopes of the betatron functions alpha-x, alpha-y=0, matching of the orbit offset VDX, and matching of the slope of the dispersion function DX. The major advantage of the SYNCH program is that it allows calculations and initial conditions of the orbits. A first command for the initial conditions in SYNCH includes reading of a matrix with initial values of the betatron Functions values in SYNCH called "IBET." These include PHASE or "TUNE-X", "BETA-X", slope of beta-x—"ALPHA-X", "gammaX", dispersion "DX", and slope of dispersion "DXP"; PHASE or "TUNE-Y", "BETA-Y", slope of beta-y—"ALPHA-Y", "gammaX", dispersion in y "DY", and the slope of dispersion in y-plane "DYP". Additional initial conditions are provided by a particle vector called PVEC in SYNCH. The PVEC vector is used to define the initial phase space of one or more particles and includes positions of the particle in the transverse x-plane "x1", slope of the particle in the x-plane "xp1", the same for the y-plane, longitudinal positions "−ds" and the most important the "dp/p" momentum offset. In the example presented herein, the momentum offset is varying between −50%<dp/p<+50%.

Figure 9:
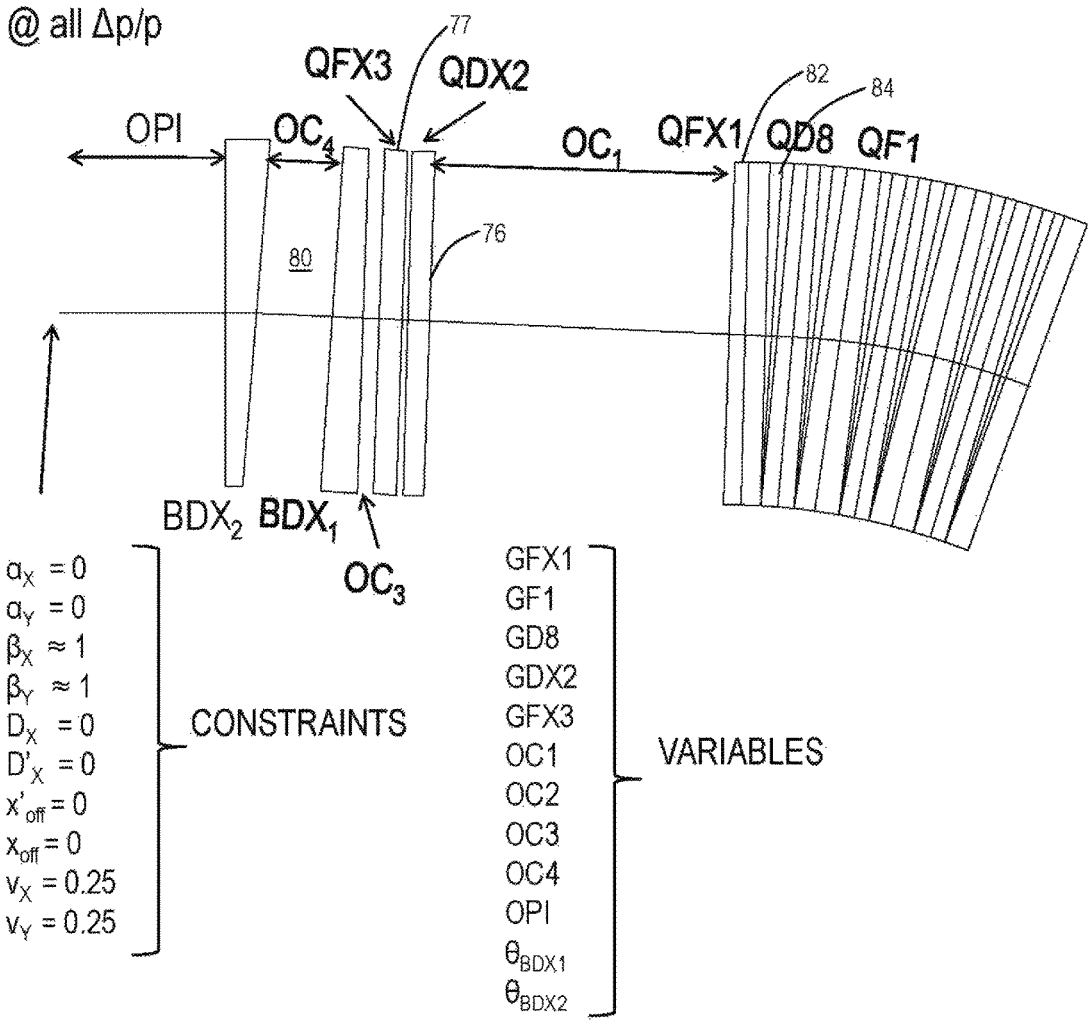
FIG. 9 is a schematic diagram of a matching procedure for matching arc sections to the straight sections of the accelerator of FIG. 1 via the matching cell of FIGS. 7 and 8.

Referring to FIG. 9, in an exemplary embodiment, a schematic diagram illustrates a half portion of the matching cell 20 and associated variables and constraints for the matching procedure 100. The straight sections 12, 14 should provide enough room for placement of the injection and extraction kickers and septa and the RF cavities. SYNCH includes a general fitting routine program called "SOLV." Values for various objects in the half portion of the matching cell 20 can be determined using SOLV. The SOLV routine calls the particle TRACKING named "TRKB" with the initial conditions, as mentioned above, IBET and PVEC, with names previously defined of the tracking command TRKB and the name of initial conditions IBET and name of PVEC. The next several rows (up to thirteen) are used for the variables as presented in the table in FIG. 14. The variables used in the general fitting routine program are presented in FIG. 9. The first variables are gradients, GFX1, GF1, GD8, GDX2, GFX3, of their associated magnets QFX1, QF1, QD8, QDX2, QFX3 respectively. The next variables are drifts OC1, OC2, OC3, OC4, OPI. The first drift OC1 is a variable but is required to be a certain distance for placement of the kickers 21, 25 or septa 22, 26, e.g. greater than 1 m. The quadrupoles 76, 77 have variable gradients GDX2 and GFX3. The two opposite bending magnets 80 (denoted as BDX1 and BDX2) have initial bending angles $\theta_{BDX1}$, $\theta_{BDX2}$ and lengths calculated from predictions presented in FIG. 10. A distance between the dipoles OC4 is also a variable as well as the last drift distance OIP. But a constraint of no less than 0.5 m was put in for OIP to allow the central distance to be at least one meter to allow a cavity placement.

The first several rows (up to thirteen) in the command for the general fitting routine program are used to set the required values for the betatron functions: beta-x, beta-y, alpha-x, alpha-y, length of the line s, dispersion function "Dx", slope of the dispersion function "Dpx", and orbit offsets and slopes at the defined position. Each requirement has also added weights for the accuracy required. A simplification of the problem comes from the mirror symmetry of the straight section 12, 14. The symmetry is fulfilled if the values of the slopes are equal to zero: alpha-x=0, alpha-y=0, DPX=0, XPX=0, i.e. constraints in FIG. 9. Additionally, the betatron phases or tunes of nu-x and nu-y are set to 0.25 ($\nu_X$=0.25 and $\nu_Y$=0.25). The reason for this constraint is to allow stable orbits from the first arc section to continue again to the next arc section. This is fulfilled if the tune difference before the circle break up, i.e. the arc section to the straight section, are equal to 2*PI. In other words, the tune difference needs to be equal to an integer: 0.25+0.25=0.5 on—the tune difference in one side is 0.5, while with additional value of 0.5 from the other straight section, will provide and integer Delta nu=1. The tunes are defined as nu-x=Phase/2*PI. The additional constraints, with a little less weight, are: the zero value of the dispersion function Dx=0, the zero offset of the orbit xp=0, and reasonable values of the amplitude functions beta-x and beta-y of about 1 m.

Thus, the constraints for the accelerator 10 are $\alpha_X$=0; $\alpha_Y$=0; $\beta_X$≈1; $\beta_Y$≈1, $D_X$=0; $D'_X$=0; $x'_{off}$=0; $x_{off}$=0; $\nu_X$=0.25; and $\nu_Y$=0.25. The variables for the matching cell 20 are GFX1, GF1, GD8, GDX2, GFX3, OC1P, OC2P, OC3P, OC4P, OPIP, $\theta_{BDX1}$, and, $\theta_{BDX2}$. The initial conditions are defined by an initial vector and Betatron functions $\beta_x$, $\alpha_x$, $\beta_y$, $\alpha_y$, $D_x$, $D'_x$@Δp/p=0.5, 0.4, . . . , −0.4, −0.5. The initial vector includes initial orbit offsets ($x_{off}$, $x'_{off}$, $y_{off}$, $y'_{off}$)@Δp/p=(0.50, 0.40, . . . , −0.50), −Δs longitudinal orbit offsets ($\Delta s=C_{\Delta p/p}-C_{\Delta p/p=0}$), and value of the Δp/p. To start, a total number of constraints for momentum values of: −50%, −40%, −30%, −20%, −10%, +10%, +20%, +30%, +40%,+50% leads to a total number of variables of 30 cells×2=60 different gradients +2θ+3 straight section gradients=65. However, it was determined that is in only necessary to perform the matching procedure 100 at @dp/p=+50% and @dp/p=−50%, i.e., the maximum and minimum energies to find a solution.

There are total of twenty of the general fitting routines used for the momentum offsets: dp/p=+50%, dp/p=+40%, dp/p=+30%, dp/p=0, dp/p=−10%, dp/p=20%, . . . , dp/p=−40%, and dp/p=−50%. The solutions for each value of dp/p are compared and an additional SYNCH routine called Fixed point FIXPT is used fo representing a search for the closed orbit solution for all momenta dp/p=+50, dp/p=45%, dp/p=40%, dp/p=35%, . . . dp/p=−45%, and dp/p=−50%. FIG. 7, for example, shows a solution for the orbit offsets for different proton energies—momenta −50%<dp/p<50%, obtained from the fitting.

Figure 10:
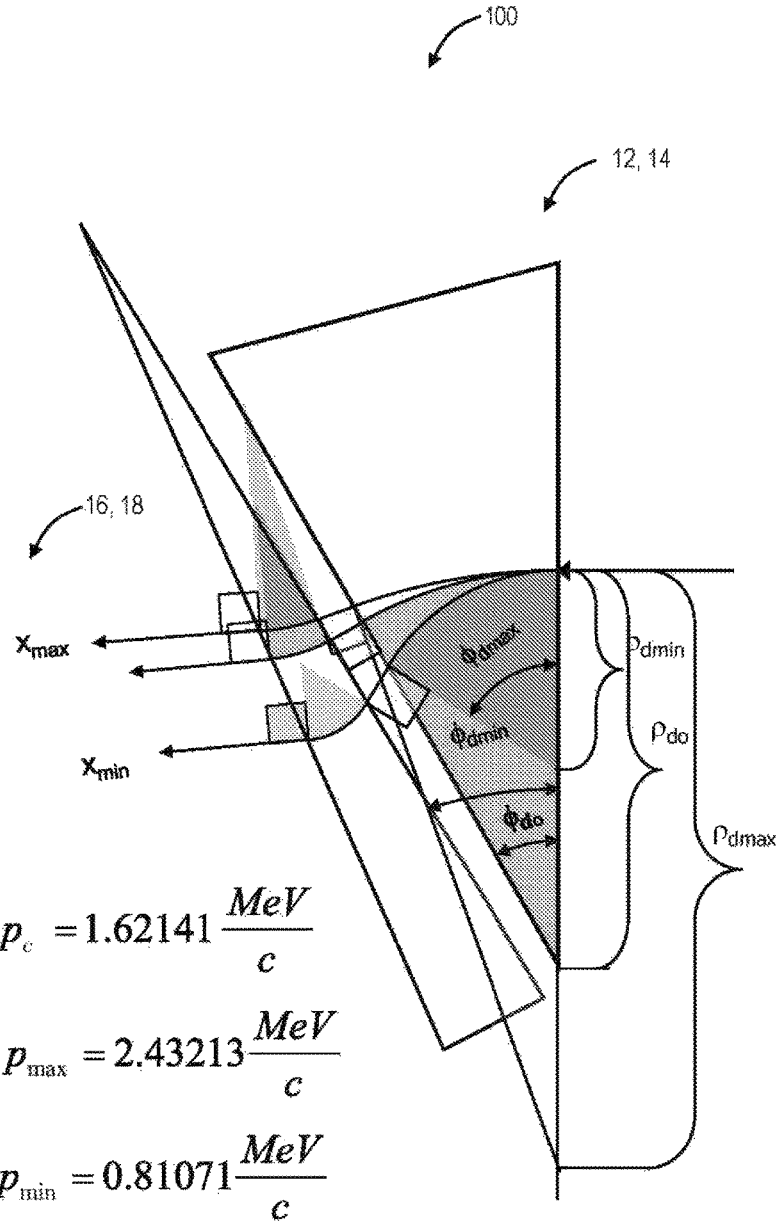
FIG. 10 is a schematic diagram of the matching procedure of FIG. 9 showing the straight sections.

Referring to FIG. 10, in an exemplary embodiment, a schematic diagram illustrates a matching procedure 100 for matching the arc sections 16, 18 to the straight sections 12, 14. Input parameters are: $x_{max}$ and $x_{min}$ from the arc sections 16, 18, $p_{max}$, $p_o$, and $p_{min}$, $D_x$, $\beta_x$, $\beta_y$, and the unknowns are: $B_D$, $B_F$, $F_{fo}$, $F_{do}$, and $l_o$. These unknowns are to be matched to the input parameters of the accelerator 10: $\beta_x$, $\beta_y$, $\alpha_x$, $\alpha_y$. The following formulas/calculations relate to FIG. 10.

$$\rho_{d0} = \frac{p_c}{eB_D} \rightarrow p_c = 1.62141\frac{\text{MeV}}{c}$$

$$\rho_{dmax} = \frac{\rho_{max}}{eB_D} \rightarrow p_{max} = 2.43213\frac{\text{MeV}}{c}$$

$$\rho_{dmin} = \frac{\rho_{min}}{eB_D} \rightarrow p_{min} = 0.81071\frac{\text{MeV}}{c}$$

$$\rho_{f0} = \frac{p_c}{eB_F}$$

$$\rho_{fmax} = \frac{p_{max}}{eB_F}$$

$$\rho_{fmin} = \frac{p_{min}}{eB_D}$$

Figure 11:
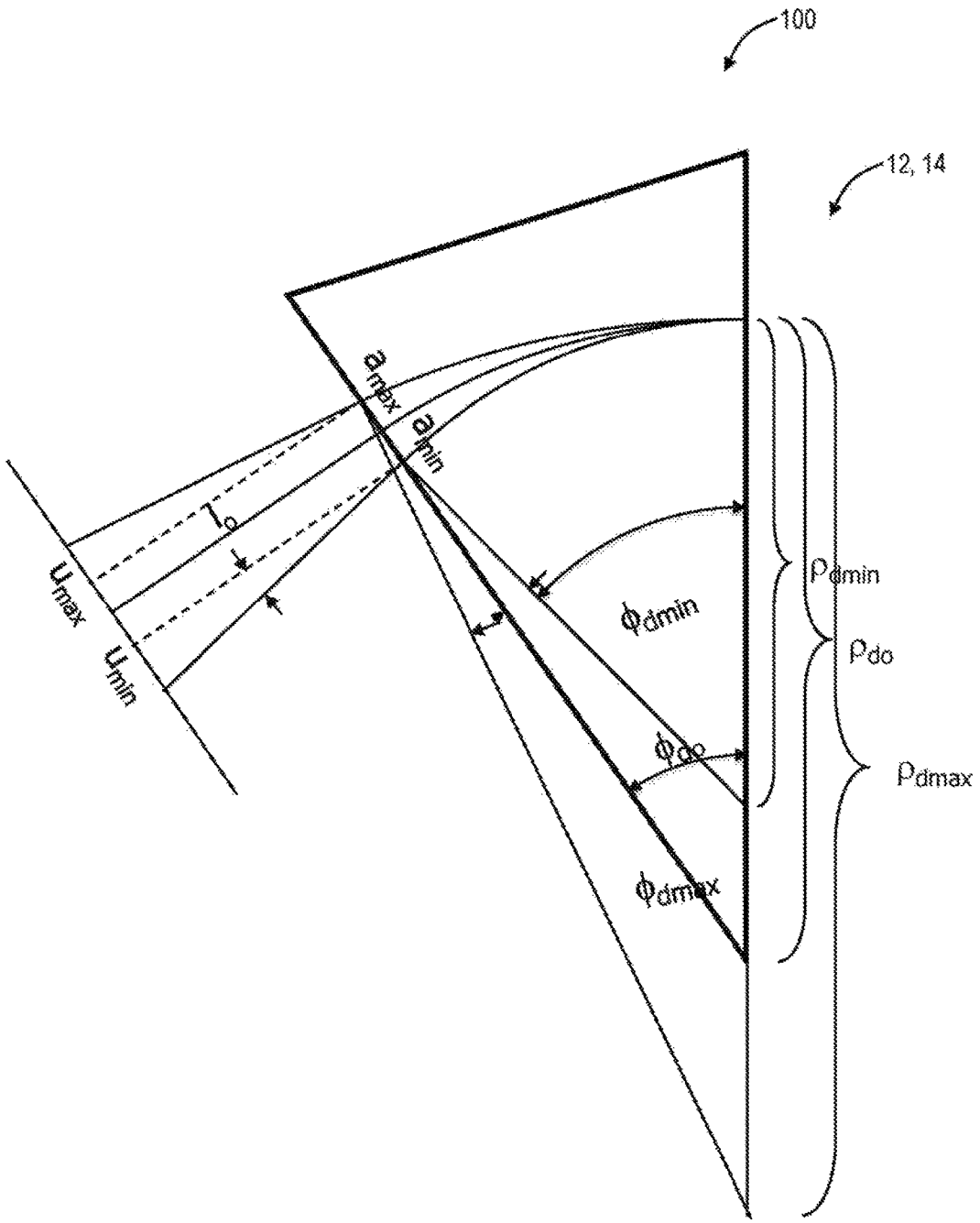
FIG. 11 is a schematic diagram of the matching procedure of FIG. 9 showing the cell entrance at the arc sections.

Referring to FIG. 11, in an exemplary embodiment, a schematic diagram continues to illustrate the matching procedure 100 showing the straight sections 12, 14. The following formulas/calculations relate to FIG. 11.

$$\frac{\rho_{dmin}}{\sin\phi_{d0}} = \frac{\rho_{d0} - a_{min}}{\sin\phi_{dmin}}$$

$$\frac{\rho_{dmax}}{\sin\phi_{d0}} = \frac{\rho_{d0} - a_{maz}}{\sin\phi_{dmax}}$$

$$a_{min} = \rho_{d0} - \rho_{dmin}\frac{\sin\phi_{dmin}}{\sin\phi_{d0}}$$

$$u_{min} = a_{min} - \ell_0\tan(\phi_{dmin} - \phi_{d0})$$

$$a_{max} = \rho_{dmax}\frac{\sin\phi_{dmax}}{\sin\phi_{d0}} - \rho_{d0}$$

$$u_{max} = a_{max} - \ell_0\tan(\phi_{d0} - \phi_{dmax})$$

Figure 12:
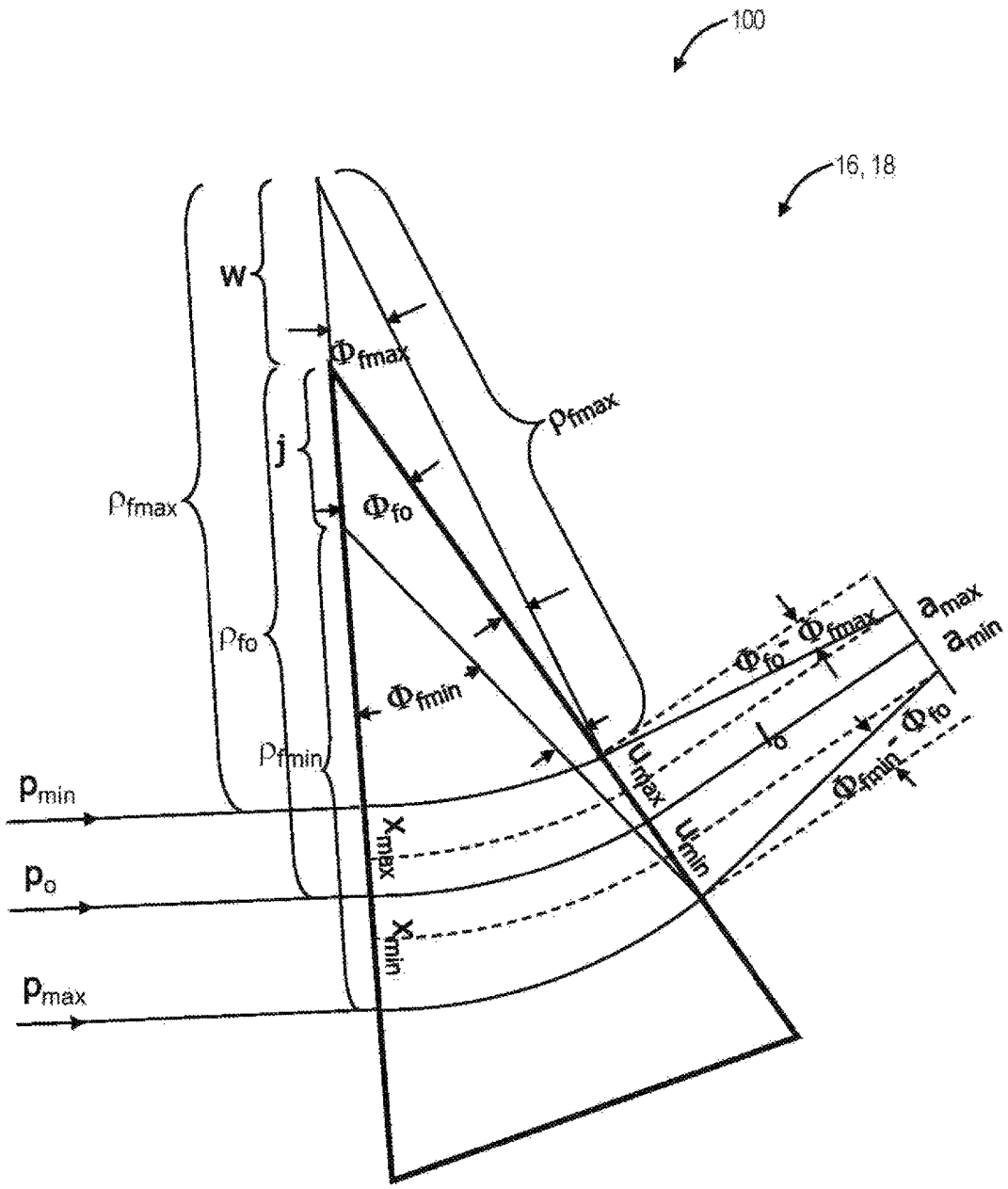
FIG. 12 is a schematic diagram of the matching procedure of FIG. 9 showing the matching arc sections to the straight sections.

Referring to FIG. 12, in an exemplary embodiment, a schematic diagram continues to illustrate the matching procedure 100 showing the cell entrance at the arc sections 16, 18. The following formulas/calculations relate to FIG. 12.

$$\frac{j}{\sin(\phi_{fmin} - \phi_{f0})} = \frac{\rho_{fmin}}{\sin\phi_{f0}}$$

$$\frac{w}{\sin(\phi_{fo} - \phi_{fmax})} = \frac{\rho_{fmax}}{\sin\phi_{f0}}$$

$$\frac{\rho_{f0} - u_{max}}{\sin(\phi_{fmax})} = \frac{\rho_{fmax}}{\sin\phi_{f0}}$$

$$\frac{\rho_{f0} + u_{min}}{\sin(\phi_{fmin})} = \frac{\rho_{fmin}}{\sin\phi_{f0}}$$

$$x_{max} = \rho_{f0} + w - \rho_{fmax}$$

$$x_{max} = \rho_{f0} + \rho_{fmax}\frac{\sin(\phi_{f0} - \phi_{fmax})}{\sin\phi_{f0}} - \rho_{fmax}$$

$$x_{min} = \rho_{fmin} + j - \rho_{f0}$$

$$x_{min} = \rho_{fmin}\left[1 + \frac{\sin(\phi_{fmin} - \phi_{f0})}{\sin\phi_{f0}}\right] - \rho_{f0}$$

$$\Phi_{fo} - \Phi_{fmax} = \Phi_{do} - \Phi_{dmax}$$

$$\Phi_{fmin} - \Phi_{fo} = \Phi_{dmin} - \Phi_{do}$$

$$u_{max} = a_{max} + l_0\tan(\Phi_{fo} - \Phi_{fmax})$$

$$u_{min} = a_{min} + l_0\tan(\Phi_{fmin} - \Phi_{fo})$$

$$u_{max} = \rho_{f0} - \rho_{fmax}\frac{\sin\phi_{fmax}}{\phi_{f0}}$$

-continued $$u_{min} = \rho_{fmin}\frac{\sin\phi_{fmin}}{\phi_{f0}} - \rho_{f0}$$

Figure 13:
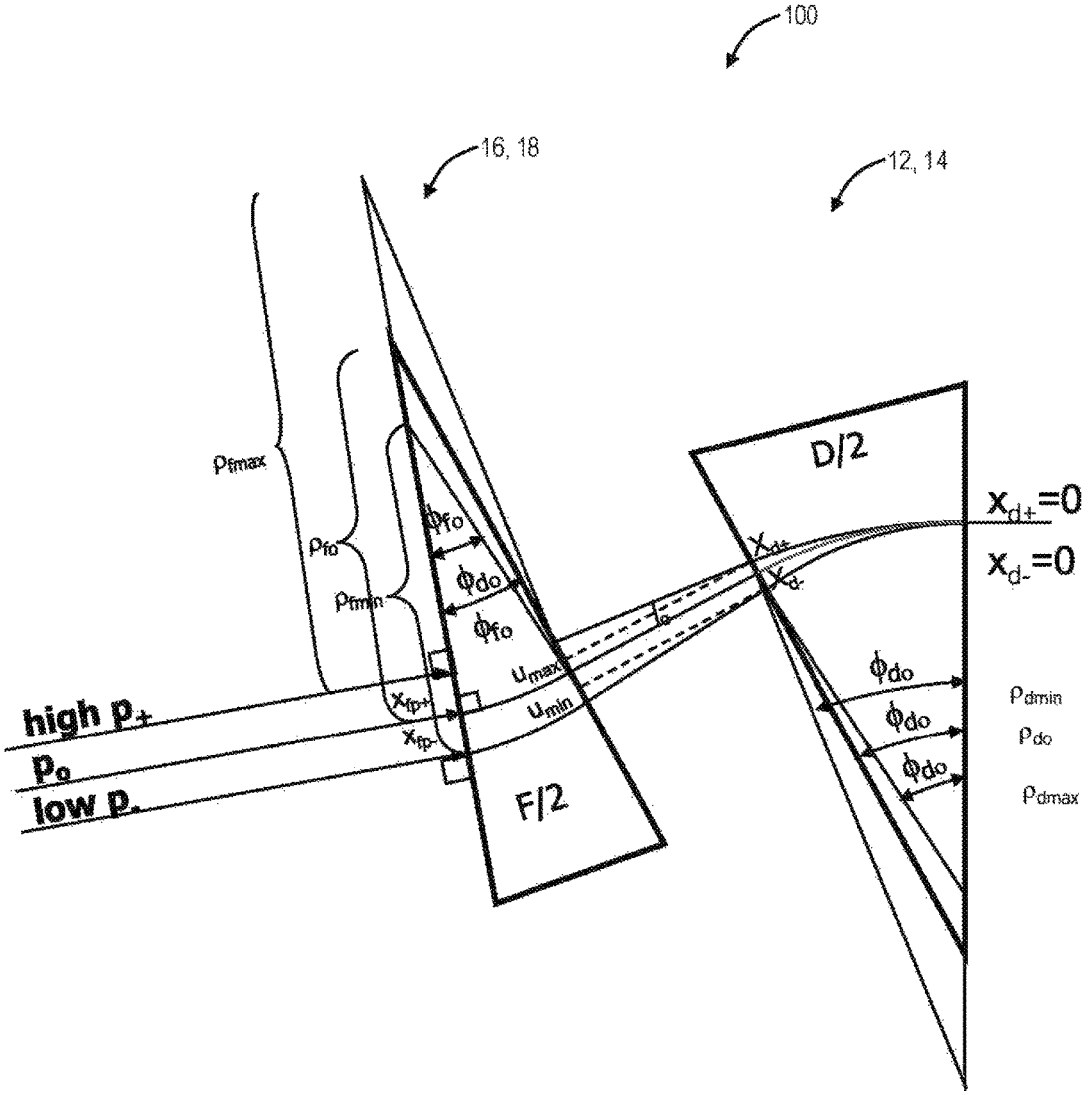
FIG. 13 is a schematic diagram of a portion of the matching cell of FIGS. 7 and 8 and associated variables and constraints for the matching procedure of FIGS. 9-12.

Referring to FIG. 13, in an exemplary embodiment, a schematic diagram continues to illustrate the matching procedure 100 for matching the arc sections 16, 18 to the straight sections 12, 14. The following formulas/calculations relate to FIG. 13.

$$X_p = \frac{r_0}{2n_0}\left\{(1 - n_0) + \sqrt{(1 - n_0)^2 - 4n_0(\Delta p / p_0)}\right\}$$

$$X_{dp} = \frac{\rho_0}{2n_d}\left\{(1 - n_d) + \sqrt{(1 - n_d)^2 - 4n_d(\Delta p / p_0)}\right\}$$

$$X_{fp} = \frac{\rho_0}{2n_f}\left\{(1 - n_{df}) + \sqrt{(1 - n_f)^2 - 4n_f(\Delta p / p_0)}\right\}$$

$$n_0 = -\frac{r}{B}\frac{dB}{dr}\Big|_{p0}$$

$$n_f = -\frac{\rho_f + x_{f\perp}}{B_f}G_{f|p=p0}$$

$$n_d = -\frac{\rho_{d0} + X_{dp}}{B_d}G_{d|p=p0}$$

$$\alpha_f \equiv \sqrt{1 - n_f\phi_f}$$

$$\alpha_d \equiv \sqrt{n_d - 1\phi_d}$$

$$\tan\chi = \frac{1}{r}\frac{dr}{d\phi}$$

$$\frac{A_f}{A_d} \equiv \sqrt{\frac{n_d - 1}{1 - n_f}}\frac{\rho_{f0}\sinh\alpha_d}{\rho_{d0}\sin\alpha_f}$$

$$A_d = \frac{X_{fp} - X_{dp}}{\cosh\alpha_d + \frac{\sqrt{n_d - 1}}{\rho_{d0}}\sinh\alpha_d\left[\ell - \frac{\rho_{f0}}{\sqrt{1 - n_f}\tan\alpha_f}\right]}$$

$$x_{d\perp} - X_{dp} \equiv A_d\cosh\alpha_d$$

$$\tan\chi_d \cong \frac{A_d}{\rho_{d0}}\sqrt{n_d - 1}\sinh\alpha_d$$

$$x_{f\perp} - X_{fp} \equiv A_f\cosh\alpha_f$$

$$\tan\chi_f \cong \frac{A_f}{\rho_{f0}}\sqrt{n_f - 1}\sin\alpha_f$$

$$x_{d+} = X_{dp} + A_d\cosh\alpha_d$$

$$x_{d+} = X_{dp} + \frac{(X_{fp} - X_{dp})\cosh\alpha_d}{\cosh\alpha_d + \frac{\sqrt{n_d - 1}}{\rho_{d0}}\sinh\alpha_d\left[l_0 - \frac{\rho_{f0}}{\sqrt{1 - n_f}\tan\alpha_f}\right]} = 0$$

Referring to FIG. 14, in an exemplary embodiment, a table illustrates a calculation of the matching procedure for the variables GFX1, GF1, GD8, GDX2, GFX3, OC1P, OC2P, OC3P, OC4P, OPIP, $\theta_{BDX1}$, and, $\theta_{BDX2}$.

Figure 15:
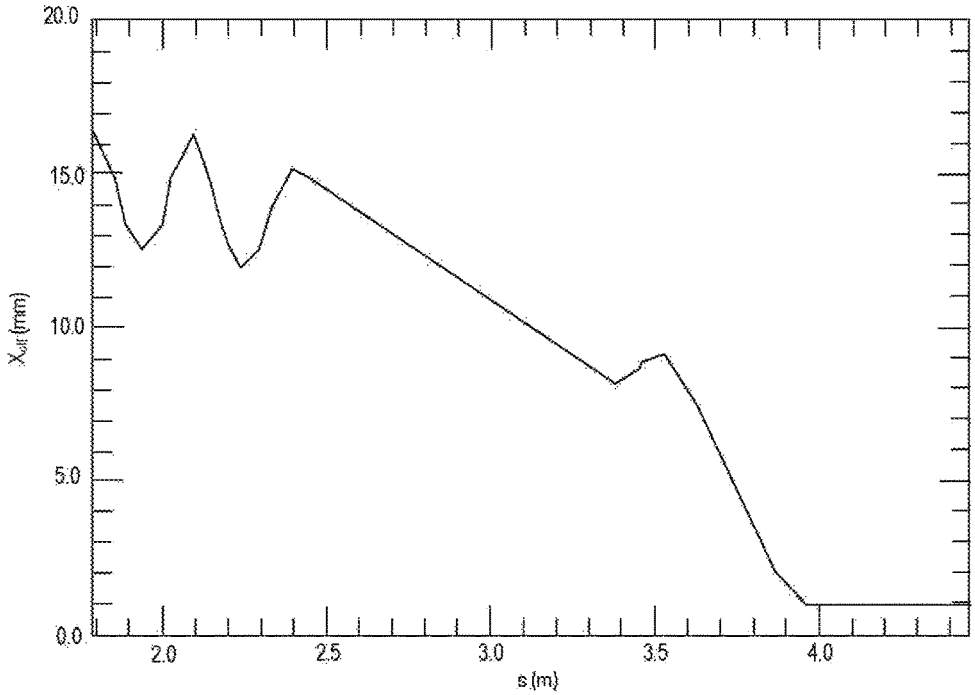
FIG. 15 is a graph of $x_{off}$ versus distance showing matching of the orbit offsets to the straight sections of the accelerator of FIG. 1 at dp/p=+50%.
Figure 16:
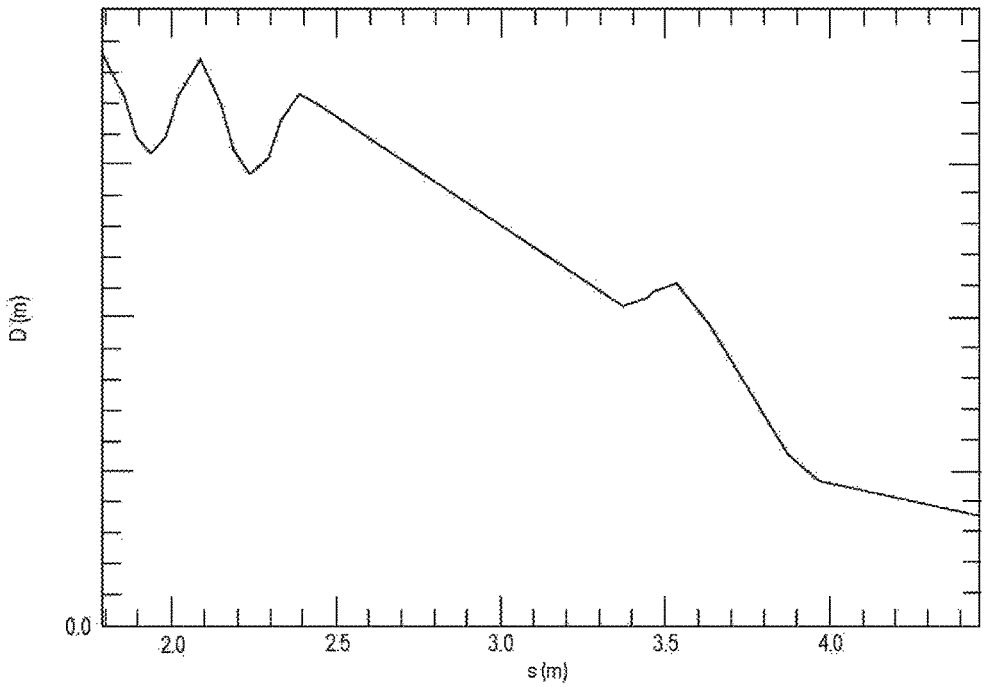
FIG. 16 is a graph of dispersion, D, versus distance showing matching of the orbit offsets to the straight sections of the accelerator of FIG. 1 at dp/p−+50%.
Figure 17:
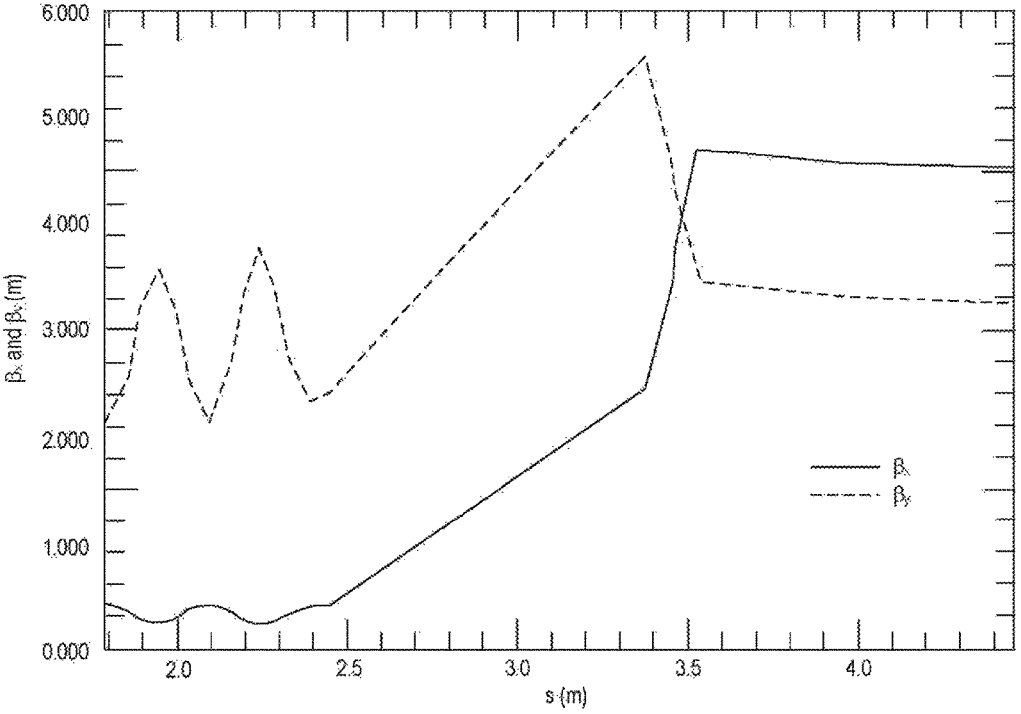
FIG. 17 is a graph of $\beta_x$ and $\beta_y$@dp/p=50% showing matching of the orbit offsets to the straight sections of the accelerator of FIG. 1 at dp/p=+50.

Referring to FIGS. 15-17, in exemplary embodiments, various graphs illustrate aspects of the matching procedure 100. FIG. 15 is a graph of $x_{off}$ versus distance showing matching of the orbit offsets to the straight sections 12, 14 at dp/p=+50%. FIG. 16 is a graph of dispersion, D, versus distance showing matching of the orbit offsets to the straight sections 12, 14 at dp/p=+50%. FIG. 17 is a graph of $\beta_x$ and $\beta_y$@dp/p=50% showing matching of the orbit offsets to the straight sections 12, 14 at dp/p=+50.

Figure 18:
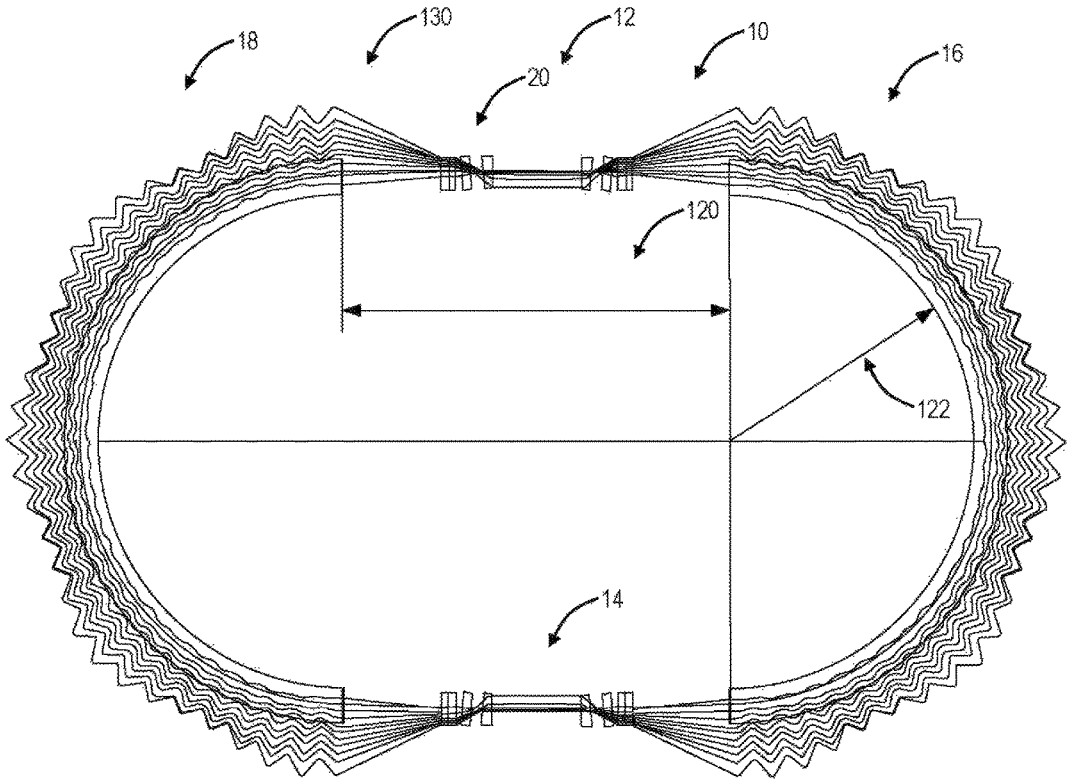
FIG. 18 is a schematic diagram of the accelerator of FIG. 1 with orbits for energies in a range between 31 MeV to 250 MeV magnified 20 times.
Figure 19:
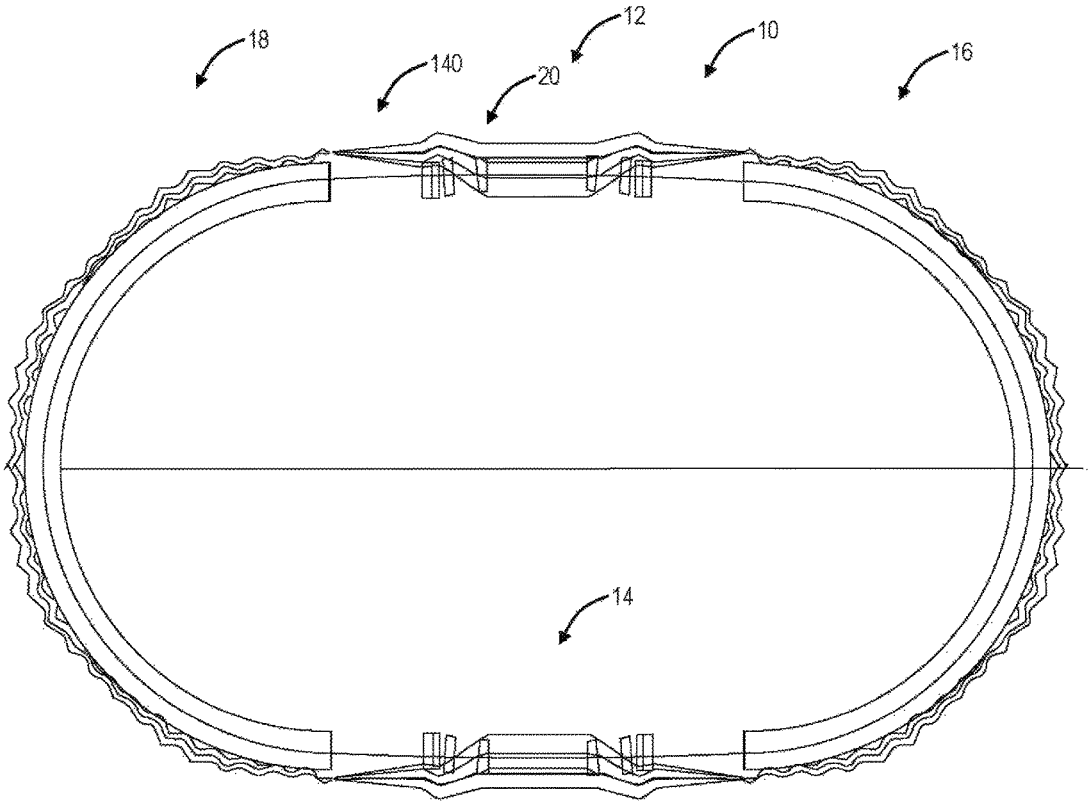
FIG. 19 is a schematic diagram of the accelerator of FIG. 1 with dispersion over the sections for −40%<dp/p<50%.
Figure 20:
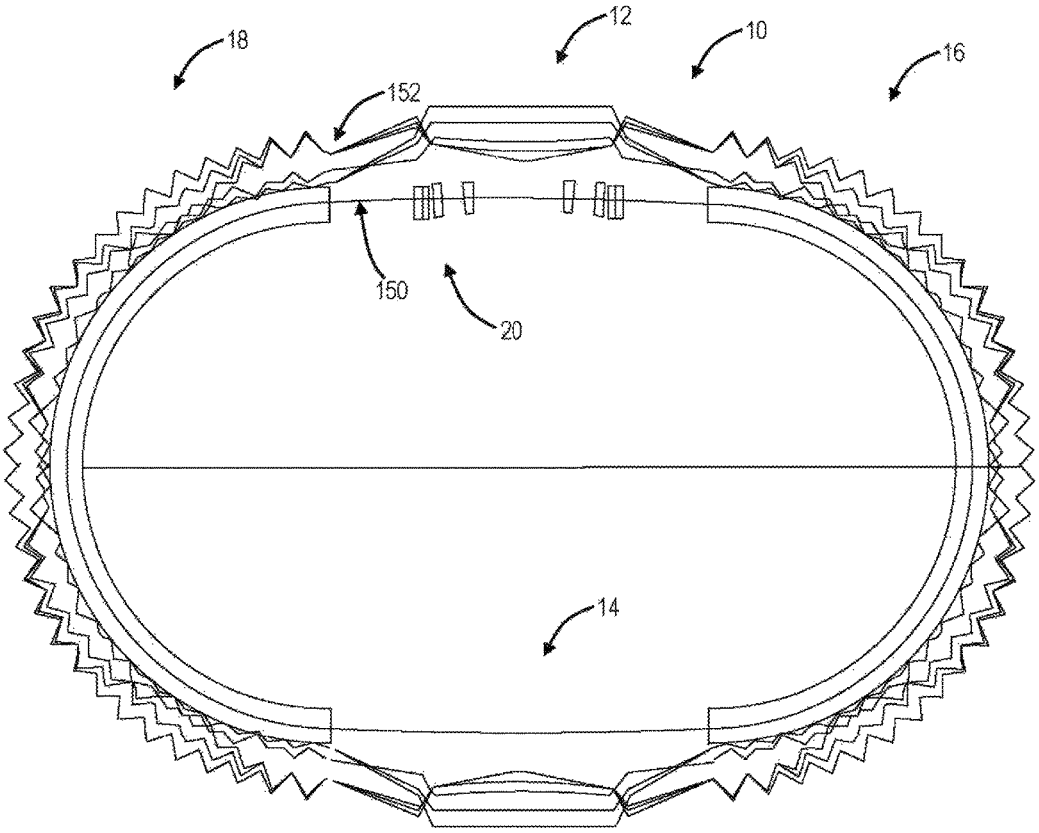
FIG. 20 is a schematic diagram of the accelerator of FIGS. 1 of βx and βy over the sections for −40%<dp/p<50%.

Referring to FIGS. 18-20, in exemplary embodiments, schematic diagrams illustrate the accelerator 10 showing particle orbits, dispersion, and βx and βy between the sections 12, 14, 16, 18. In these exemplary embodiments, the accelerator 10 includes the various sections 12, 14, 16, 18 and the matching cells 20 based on the matching procedure 100. In an exemplary embodiment, the straight sections 12, 14 can have a length 120 of about 4.5 m, and the arc sections 16, 18 can have a radius 122 of about 2.8 m. FIG. 18 includes magnified orbits 130 for energies in a range between 31 MeV to 250 MeV are magnified 20 times. FIG. 19 includes dispersion 140 over the sections 12, 14, 16, 18 for −40%<dp/p<50%. FIG. 20 includes βx 150 and βy 152 over the sections 12, 14, 16, 18 for −40%<dp/p<50%.

Figure 21:
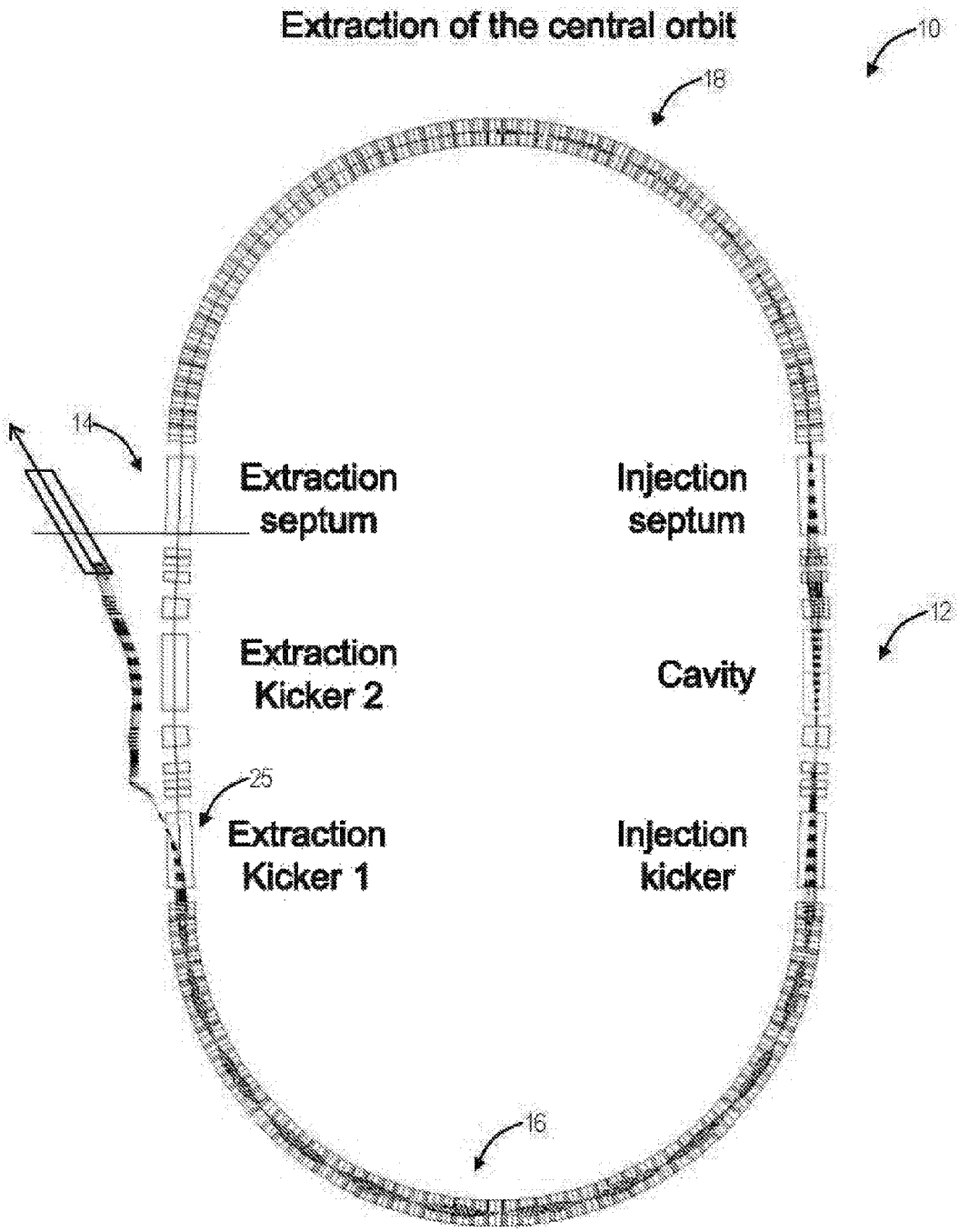
FIG. 21 is a schematic diagram of the accelerator of FIG. 1 showing extraction of the central orbit via an extraction kicker.
Figure 22:
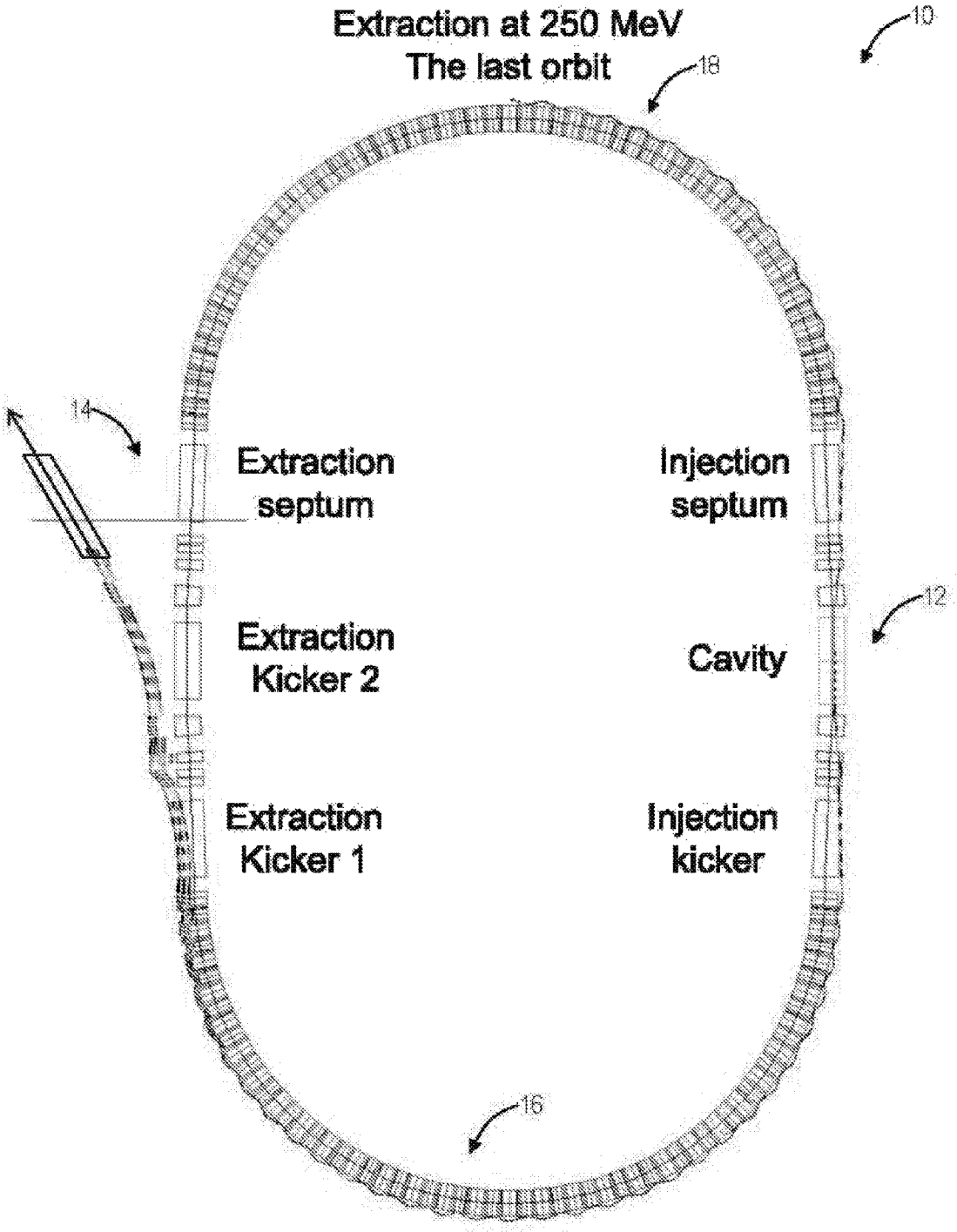
FIG. 22 is a schematic diagram of the accelerator of FIG. 1 showing extraction at 250 MeV of the last orbit via an extraction kicker.
Figure 23:
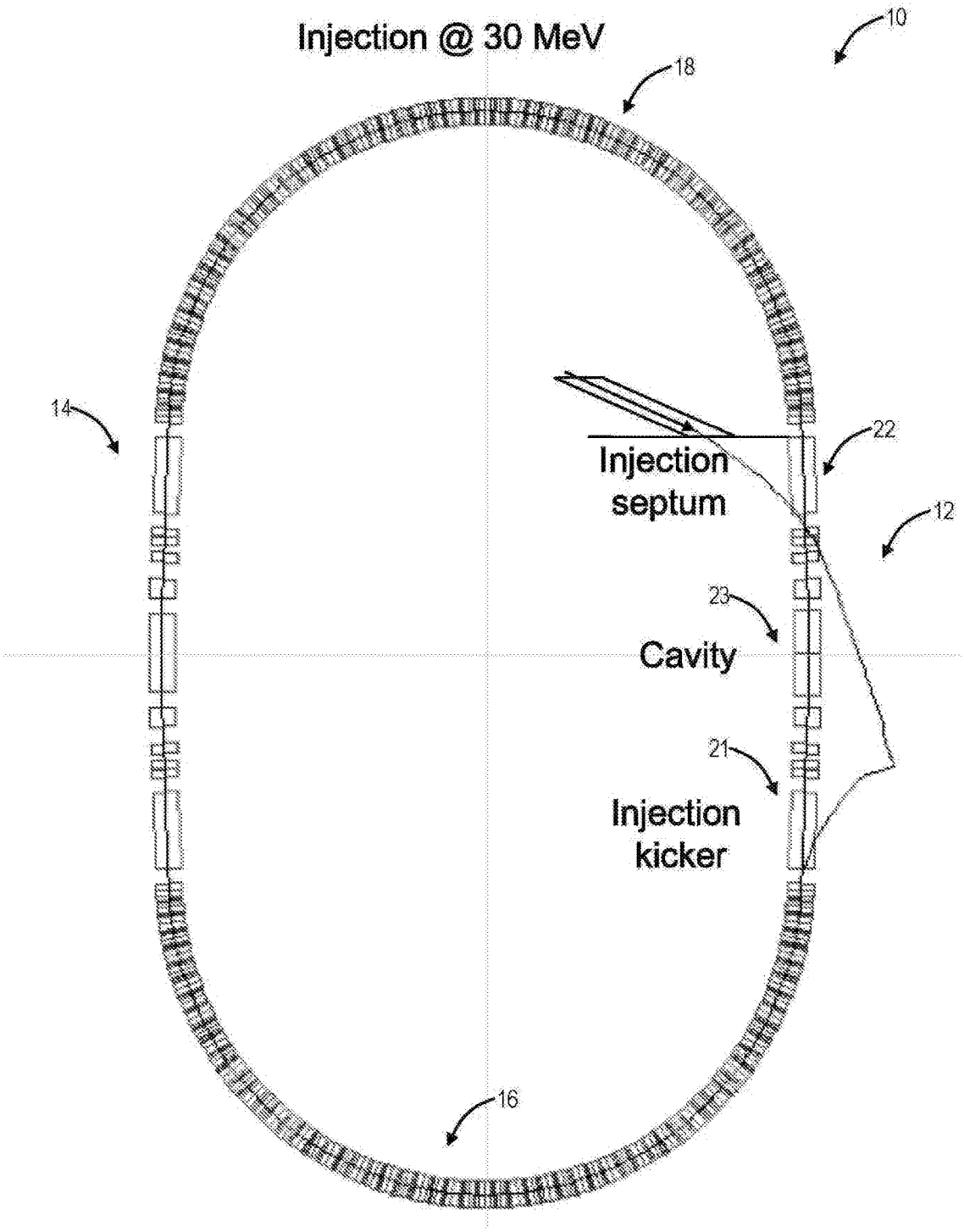
FIG. 23 is a schematic diagram of the accelerator of FIG. 1 showing injection at 30 MeV via an injection septum, a cavity 23 and an injection kicker 21.
Figure 24:
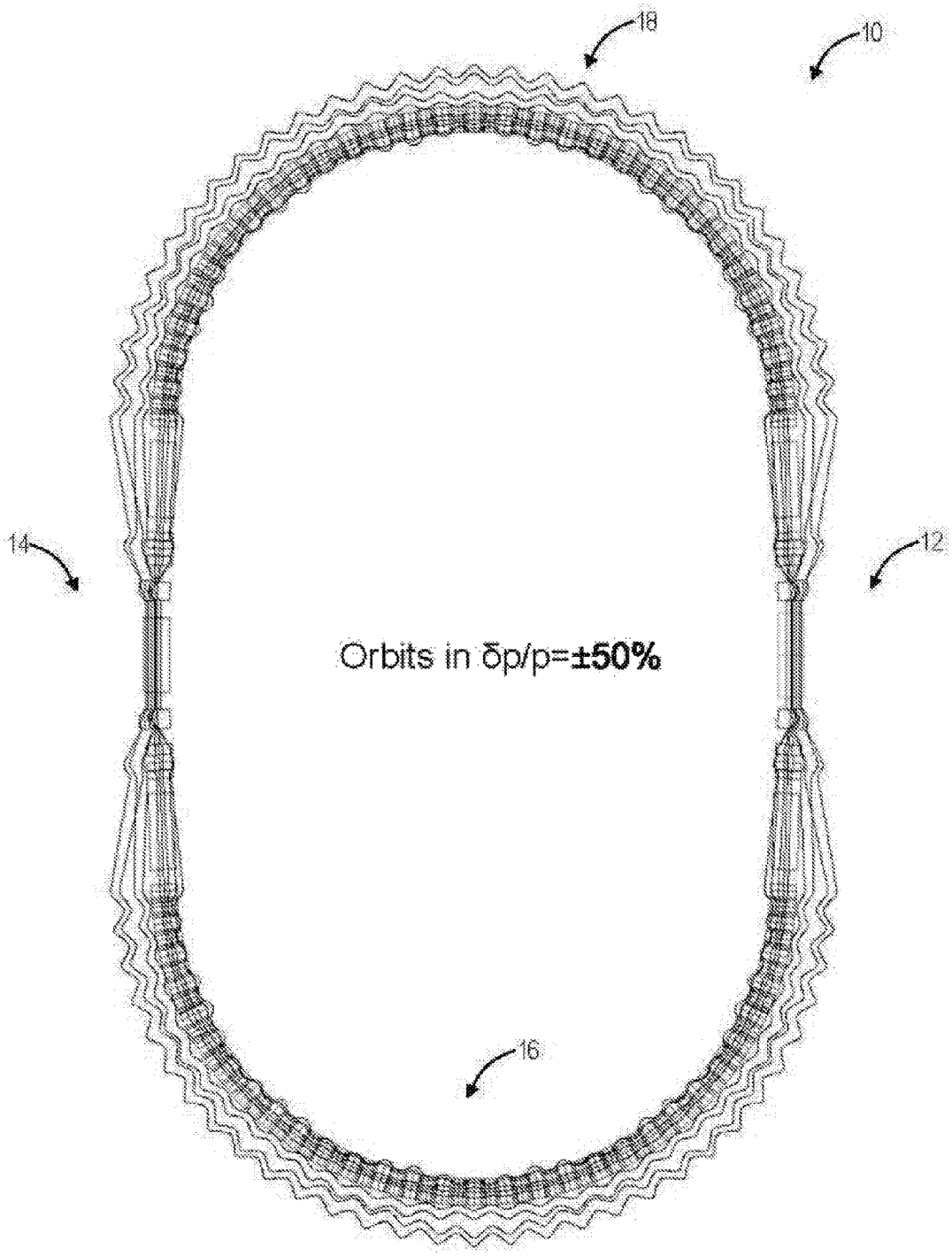
FIG. 24 is a schematic diagram of the accelerator of FIG. 1 showing orbits in δp/p=±50%.

Referring to FIGS. 21-24, in exemplary embodiments, schematic diagrams illustrate the accelerator 10 showing extraction, injection, and orbits. FIG. 21 illustrates extraction via the extraction kicker 25 of the central orbit. FIG. 22 illustrates extraction at 250 MeV via the extraction kicker 25 of the last orbit. FIG. 23 illustrates injection via the injection septum 22, the cavity 23 and the injection kicker 21 at 30 MeV. FIG. 24 illustrates orbits in δp/p=±50%.

The orbit offsets in the accelerator 10 are within 11 mm<Δx<17 mm allowing use of a small aperture, e.g., 35 mm. With the outside diameter of 21 cm from the available Nd—Fe—B (for temperatures less than 70 C) materials, a bending dipole field of 2.4 T could be obtained. Advantage of the accelerator is very small magnets and simplified operation, as the magnets are permanent.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure and are intended to be covered by the following claims.

What is claimed is:

1. A non-scaling fixed field alternating gradient accelerator, comprising:

a first matching cell connecting a first arc section comprising permanent magnets to a second arc section comprising permanent magnets with an intermediate first straight section having at least one cavity, the first matching cell spaced about the cavity, wherein the first matching cell is configured to match particle orbits between the first straight section and the first arc section and between the first straight section and the second arc section; and a second matching cell connecting the first arc section to the second arc section with an intermediate second straight section having at least one extraction kicker, the second matching cell spaced about the at least one extraction kicker, wherein the second matching cell is configured to match particle orbits between the second straight section and the first arc section and between the second straight section and the second arc section, wherein the two arc sections have radii of approximately 2.85 meters.

2. The accelerator of claim 1, wherein the permanent magnets are of a Halbach type.

3. The accelerator of claim 1, further comprising:

an injection septum, the cavity, and an injection kicker in the first straight section configured to receive high energy particles; and the at least one extraction kicker and an extraction septum in the second straight sections configured to eject the high energy particles.

4. The accelerator of claim 1, wherein each of the first matching cell and the second matching cell comprise six magnets comprising four quadrupoles and two dipoles.

5. The accelerator of claim 4, wherein each of the first matching cell and the second matching cell comprise adjustable variables for matching conditions associated with a single particle energy value.

6. The accelerator of claim 4, wherein the four quadrupoles comprise two defocusing quadrupoles and two focusing quadrupoles and the two dipoles each comprise opposing bending magnets.

7. The accelerator of claim 1, wherein the first straight section and the second straight section each include two halves which are symmetric to one another; and wherein, due to symmetry in the first straight section and the second straight section, the matching cells require a solution for matching particle orbits from one end of one of the first arc section and the second arc section to a middle of one of the first straight section and the second straight section.

8. The accelerator of claim 1, wherein the first matching cell is configured to take values of the orbits and betatron amplitude functions and propagate them through the first straight section for each momentum coming to same conditions at the first arc section; and wherein the second matching cell is configured to take values of the orbits and betatron amplitude functions and propagate them through the second straight section for each momentum coming to same conditions at the second arc section.

* * * * *